US012305458B2

(12) United States Patent
Gar et al.

(10) Patent No.: US 12,305,458 B2
(45) Date of Patent: May 20, 2025

(54) INTERNAL SLIP DESIGN WITH MINIMUM BACKLASH FOR PACKERS SEAL ENHANCEMENT

(71) Applicant: Halliburton Energy Services, Inc., Houston, TX (US)

(72) Inventors: Shobeir Pirayeh Gar, Carrollton, TX (US); Xiaoguang Allan Zhong, Singapore (SG); Christian Alexander Ramirez, Carrollton, TX (US); David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/073,679

(22) Filed: Dec. 2, 2022

(65) Prior Publication Data

US 2024/0183234 A1 Jun. 6, 2024

(51) Int. Cl.
*E21B 23/01* (2006.01)
*E21B 33/10* (2006.01)

(52) U.S. Cl.
CPC ..... *E21B 23/01* (2013.01); *E21B 33/10* (2013.01)

(58) Field of Classification Search
CPC ..... E21B 23/01; E21B 33/10
See application file for complete search history.

(56) References Cited

U.S. PATENT DOCUMENTS

| | | | | |
|---|---|---|---|---|
| 2,887,754 | A | 5/1959 | Johnson | |
| 2,998,073 | A | 8/1961 | Clark, Jr. et al. | |
| 5,301,760 | A | 4/1994 | Graham | |
| 5,311,936 | A * | 5/1994 | McNair | E21B 43/14 166/117.6 |
| 5,343,954 | A | 9/1994 | Bohlen et al. | |
| 5,433,275 | A | 7/1995 | Melenyzer et al. | |
| 10,590,732 | B2 * | 3/2020 | Ingram | E21B 33/12 |
| 2010/0101806 | A1 | 4/2010 | Millet et al. | |
| 2011/0095485 | A1 | 4/2011 | Saylor et al. | |
| 2011/0284208 | A1 | 11/2011 | Macleod et al. | |
| 2015/0198005 | A1 | 7/2015 | Delzell et al. | |
| 2018/0252074 | A1 | 9/2018 | Hughes et al. | |
| 2019/0186232 | A1 | 6/2019 | Ingram | |

FOREIGN PATENT DOCUMENTS

| | | | |
|---|---|---|---|
| WO | 2015030958 | A1 | 3/2015 |
| WO | 2015094338 | A1 | 6/2015 |

* cited by examiner

*Primary Examiner* — Catherine Loikith
(74) *Attorney, Agent, or Firm* — Scott Richardson; Parker Justiss, P.C.

(57) ABSTRACT

Provided is a sealing/anchoring subassembly, a well system, and method. The sealing/anchoring subassembly, in one aspect, includes a mandrel, as well as a sealing/anchoring element positioned about the mandrel, the sealing/anchoring element configured to move between a radially retracted state and a radially expanded state. The sealing/anchoring subassembly, according to this aspect, also includes a ratch latch body coupled to the sealing/anchoring element, the ratch latch body configured to hold the sealing/anchoring element in the radially expanded state. The ratch latch body, in one aspect, may include a stroke sleeve having a plurality of stroke sleeve teeth disposed thereon, and a base having a plurality of base teeth disposed thereon, the stroke sleeve teeth and the base teeth configured to directly ratchet along one another to hold the sealing/anchoring element in the radially expanded state.

24 Claims, 27 Drawing Sheets

INTERNAL SLIP DESIGN WITH MINIMUM BACKLASH FOR PACKERS SEAL ENHANCEMENT

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section of the main wellbore) with a running tool. The deflector assemblies are often laterally and rotationally fixed within the main wellbore using a wellbore anchor, sealed using a wellbore seal, and then used to create an opening in the casing.

BRIEF DESCRIPTION

Reference is now made to the following descriptions taken in conjunction with the accompanying drawings, in which.

DETAILED DESCRIPTION

Figure 1:
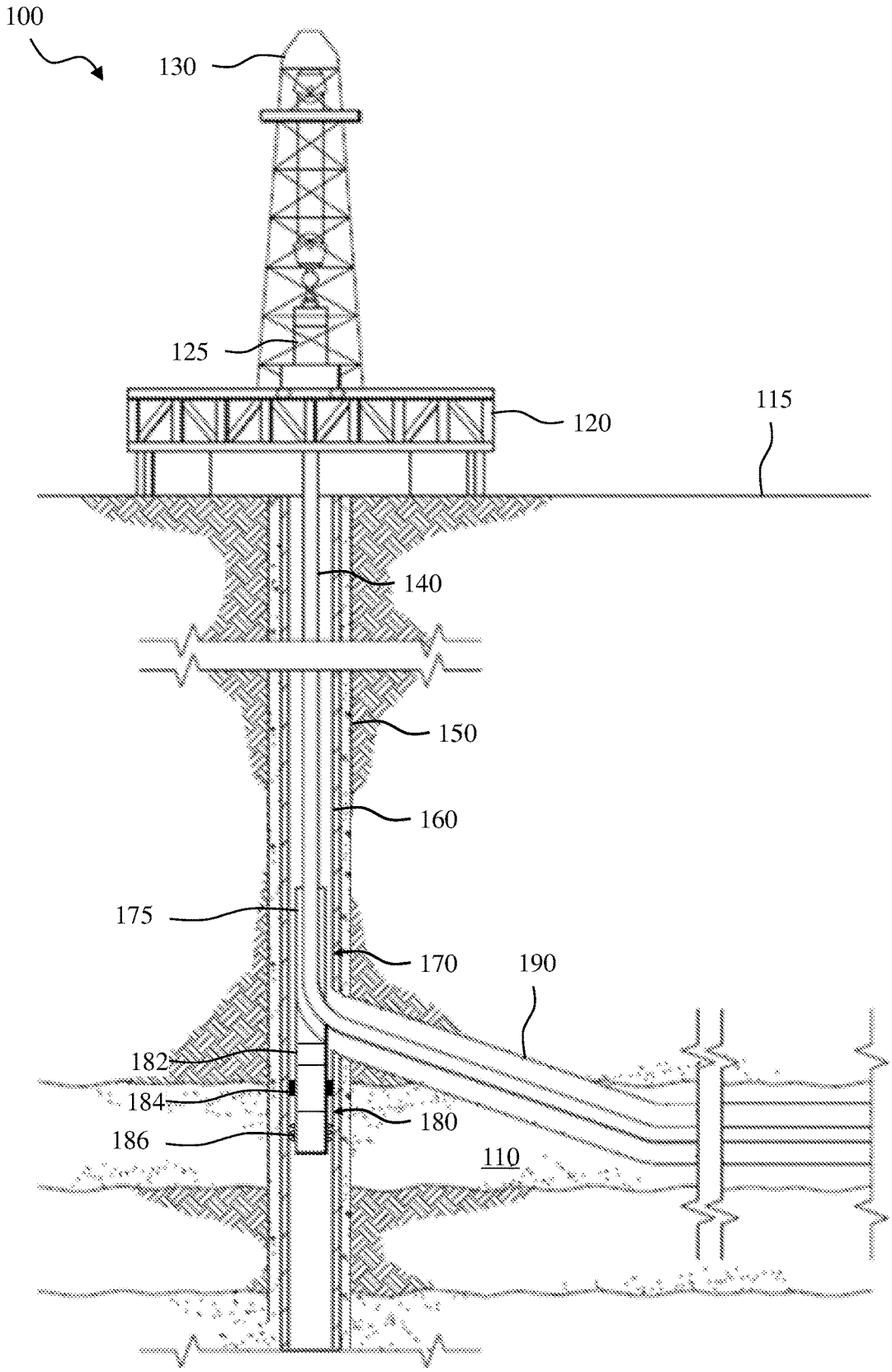
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect." "engage," "couple." "attach," or any other like term describing an interaction between elements is not meant to limit the interaction to direct interaction between the elements and may also include indirect interaction between the elements described. Unless otherwise specified, use of the terms "up," "upper." "upward." "uphole," "upstream," or other like terms shall be construed as generally away from the bottom, terminal end of a well; likewise, use of the terms "down," "lower," "downward," "downhole." "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure is based, at least in part, on the acknowledgment that body lock rings are an important part of a scaling/anchoring subassembly such as packer system, for example being used to hold the setting load once the sealing/anchoring subassembly is set and prior to differential pressure application. However, backlash or set back of the body lock ring is an inherent drawback of common locking systems, resulting in some loss in setting force and subsequent relaxation of the packer element, which eventually affects the packer scaling performance (e.g., particularly for large size packers). The present disclosure has recognized that one way to control and limit the backlash is to refine the grooves of the body lock ring. Unfortunately, doing so does not completely eliminate the backlash issues, and moreover makes the design and manufacturing process expensive.

With the foregoing acknowledgments in mind, the present disclosure has developed a new locking system that removes the independent body lock ring entirely, but in turn reduces the stroke sleeve inner diameter ($ID_{SS}$) and adds a plurality of teeth to the stroke sleeve $ID_{SS}$, the plurality of teeth functioning as an integrated locker ring of sorts, such that the stroke sleeve teeth may couple (e.g., directly couple) with the related teeth in the base. In at least one embodiment, a slot is formed within the stroke sleeve thickness between its outer diameter ($OD_{SS}$) and its $ID_{SS}$, such that the integrated locker ring can ratchet along the base without yielding the teeth or affecting the pin threads in the $OD_{SS}$ of the stroke sleeve. Thus, in at least one embodiment, the locker ring is effectively decoupled from a radially outer portion of the stroke sleeve (e.g., near the pin threads along the $OD_{SS}$ of the stroke sleeve).

The present disclosure has also recognized that it may be beneficial to include a plurality of segments in the integrated locker ring, thereby making the locker ring circumferentially discontinuous. In fact, in at least one embodiment, the locker ring includes (n) segments around its circumference, all of which are connected at a root of the stroke sleeve. The present disclosure has additionally recognized that the number (n) of segments around the circumference, the slot opening width (e), the locker ring thickness (t) and length of the slot (L) may all be properly selected to tailor the sealing/anchoring subassembly for a given geometry and/or setting load. For example, the locker ring thickness (t) and length of the slot (L) may specifically be adjusted to control the radial stiffness or flexibility of the segmented locker ring.

The present disclosure has recognized that by removing the independent body lock ring, any additional backlash introduced by the independent body lock ring goes away, which results in minimal backlash as often seen in common packer designs. What results is improved scaling performance, for example as a result of reducing the backlash, reduced cost due to removing the independent body lock ring, and enhanced reliability due to removing an extra component. Additionally, the sealing/anchoring subassembly according to the present design is simple, for example with no manufacturing design complexities, as well as is a versatile concept that can easily be applied to other packer systems.

The disclosure, in one embodiment, also describes a new method for deploying, setting, and retrieving one or more features of a whipstock assembly, as might be used to form a lateral wellbore from a main wellbore. In at least one embodiment, the whipstock assembly includes a scaling/anchoring subassembly, the sealing/anchoring subassembly including an orienting receptacle section, a sealing section, and a latching element section. In accordance with one embodiment of the disclosure, the orienting receptacle section, along with a collet and one or more orienting keys, may be used to land and position a guided milling assembly within the casing, the guided milling assembly ultimately being used to generate a pocket in the casing. In accordance with one other embodiment of the disclosure, the orienting receptacle section, along with the collet and one or more orienting keys, may be used to land and position a whipstock element section of the whipstock assembly within the casing (e.g., the whipstock element section ultimately being used to form a lateral wellbore off of the main wellbore), and cement a multilateral junction between the two.

In at least one embodiment, the sealing section may employ any known or hereafter discovered sealing elements capable of setting and/or sealing the sealing section. For example, in at least one embodiment, the sealing elements are polymer sealing elements set with a mechanical axial load about a mandrel. Ultimately, unless otherwise required, the present disclosure is not limited to any specific sealing elements.

Notwithstanding the foregoing, in at least one embodiment, the sealing section additionally includes a ratch latch body coupled to the sealing/anchoring element. The ratch latch body, in at least one embodiment, is configured to hold the sealing/anchoring element in the radially expanded state. For example, the ratch latch body according to one embodiment may include a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon. The ratch latch body according to this one embodiment may further include a base having a base outer diameter ($OD_B$) and a base inner diameter ($ID_B$), the base outer diameter ($OD_B$) having a plurality of base teeth disposed thereon. In at least this one embodiment, the stroke sleeve teeth and the base teeth are configured to directly ratchet along one another to hold the sealing/anchoring element in the radially expanded state.

In one or more other embodiments, a circumferential slot is formed within a thickness (T) of the stroke sleeve between the stroke sleeve outer diameter ($OD_{SS}$) and the stroke sleeve inner diameter ($ID_{SS}$). In this one embodiment, the slot forms an integrated locker ring. Furthermore, in one or more embodiments, the integrated locker ring includes (n) segments around its circumference, the (n) segments configured to allow the integrated locker ring to radially deform via a cantilever action.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as a sealing/anchoring subassembly 180 coupled to a downhole end thereof, the sealing/anchoring subassembly 180 designed, manufactured and/or operated according to one or more embodiments of the disclosure. The sealing/anchoring subassembly 180, in one or more embodiments, includes an orienting receptacle section 182, a sealing section 184, and a latching element section 186. The orienting receptacle section 182, in one or more embodiments, along with a collet and one or more orienting keys, may be used to land and positioned a guided milling assembly and/or the whipstock element section 175 within the casing string 160. The sealing section 184, in at least one embodiment, seals an annulus (e.g., provides a pressure tight seal) between the whipstock assembly 170 and the casing string 160. In at least one embodiment, the latching element section 186 axially, and optionally rotationally, fixes the whipstock assembly 170 within the casing string 160.

The elements of the whipstock assembly 170 may be positioned within the main wellbore 150 in one or more separate steps. For example, in at least one embodiment, the sealing/anchoring subassembly 180, including the orienting receptacle section 182, scaling section 184 and the latching element section 186 are run in hole first, and then set within the casing string 160. Thereafter, the sealing section 184 may be pressure tested. Thereafter, the whipstock element section 175 may be run in hole and coupled to the sealing/anchoring subassembly 180, for example using the orienting receptacle section 182. What may result is the whipstock assembly 170 illustrated in FIG. 1.

Figure 2A:
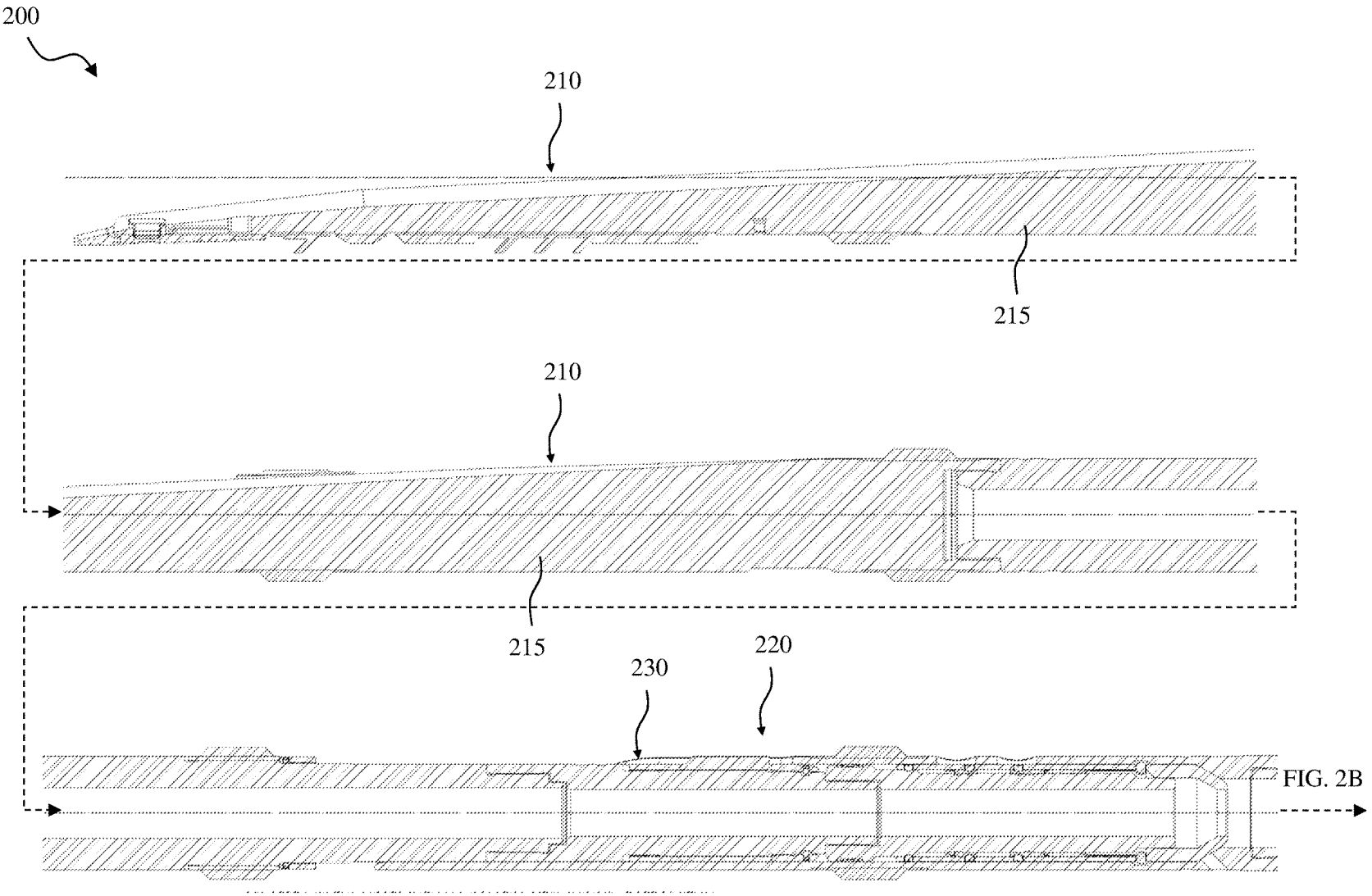
FIGS. 2A and 2B illustrate one embodiment of a whipstock assembly designed and manufactured according to one or more embodiments of the disclosure.
Figure 2B:
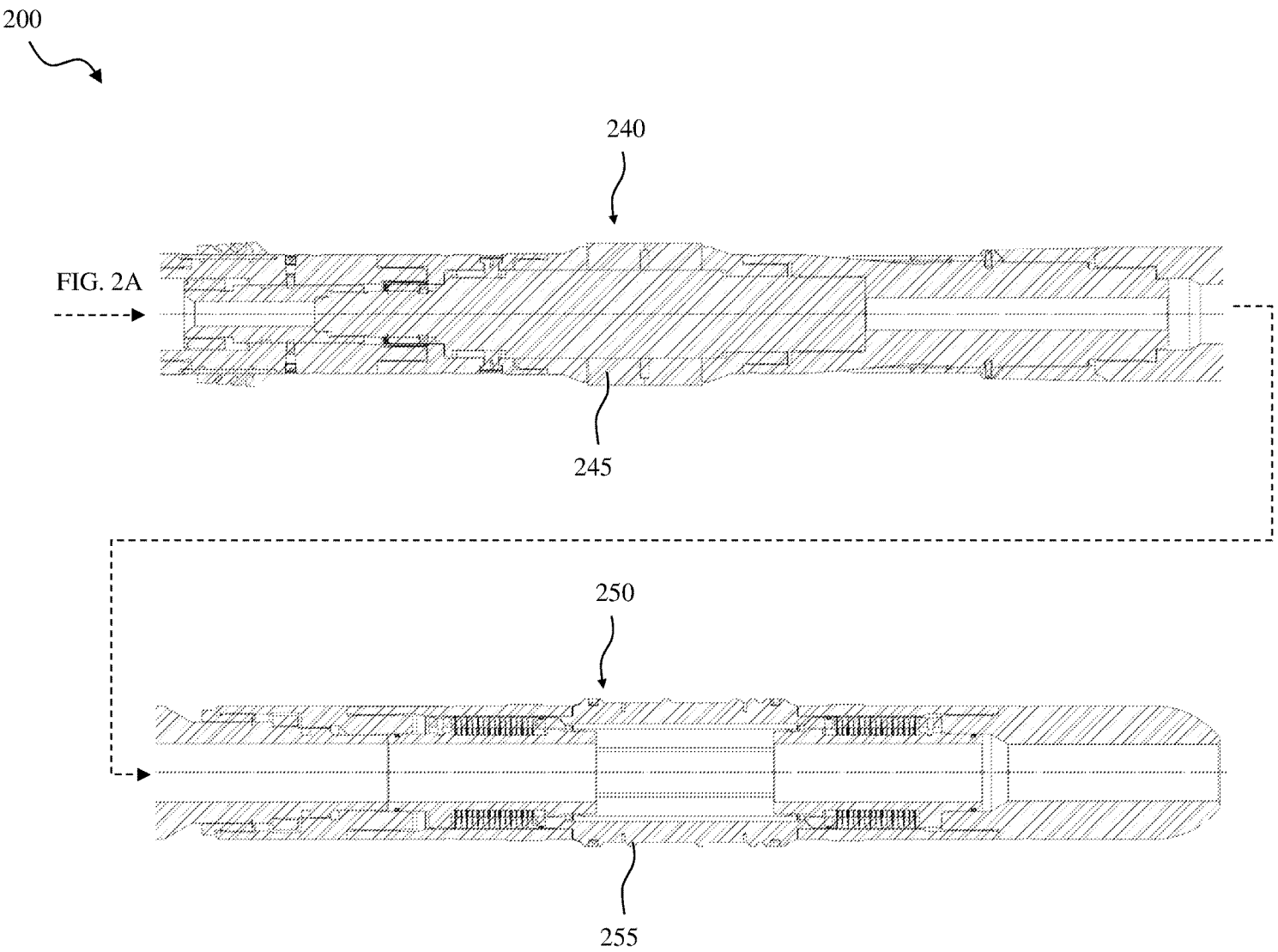

Turning now to FIGS. 2A and 2B, illustrated is one embodiment of a whipstock assembly 200 designed and manufactured according to one or more embodiments of the disclosure. The whipstock assembly 200, in the illustrated embodiment of FIGS. 2A and 2B, includes a whipstock element section 210, and a sealing/anchoring subassembly 220. The whipstock element section 210, in the illustrated embodiment, includes a whipstock element 215 (e.g., ramp element). The sealing/anchoring subassembly 220, in one or more embodiments, includes an orienting receptacle section 230 (e.g., including a muleshoe), a sealing section 240, and a latching element section 250. The sealing section 240, in the illustrated embodiment, among other features disclosed below, includes a sealing/anchoring element 245, the sealing/anchoring element 245 configured to move between a radially retracted state and a radially expanded state. The latching element section 250, in the illustrated embodiment, includes one or more latching features 255, the one or more latching features 255 configured to engage with a profile in a casing string.

Figure 3:
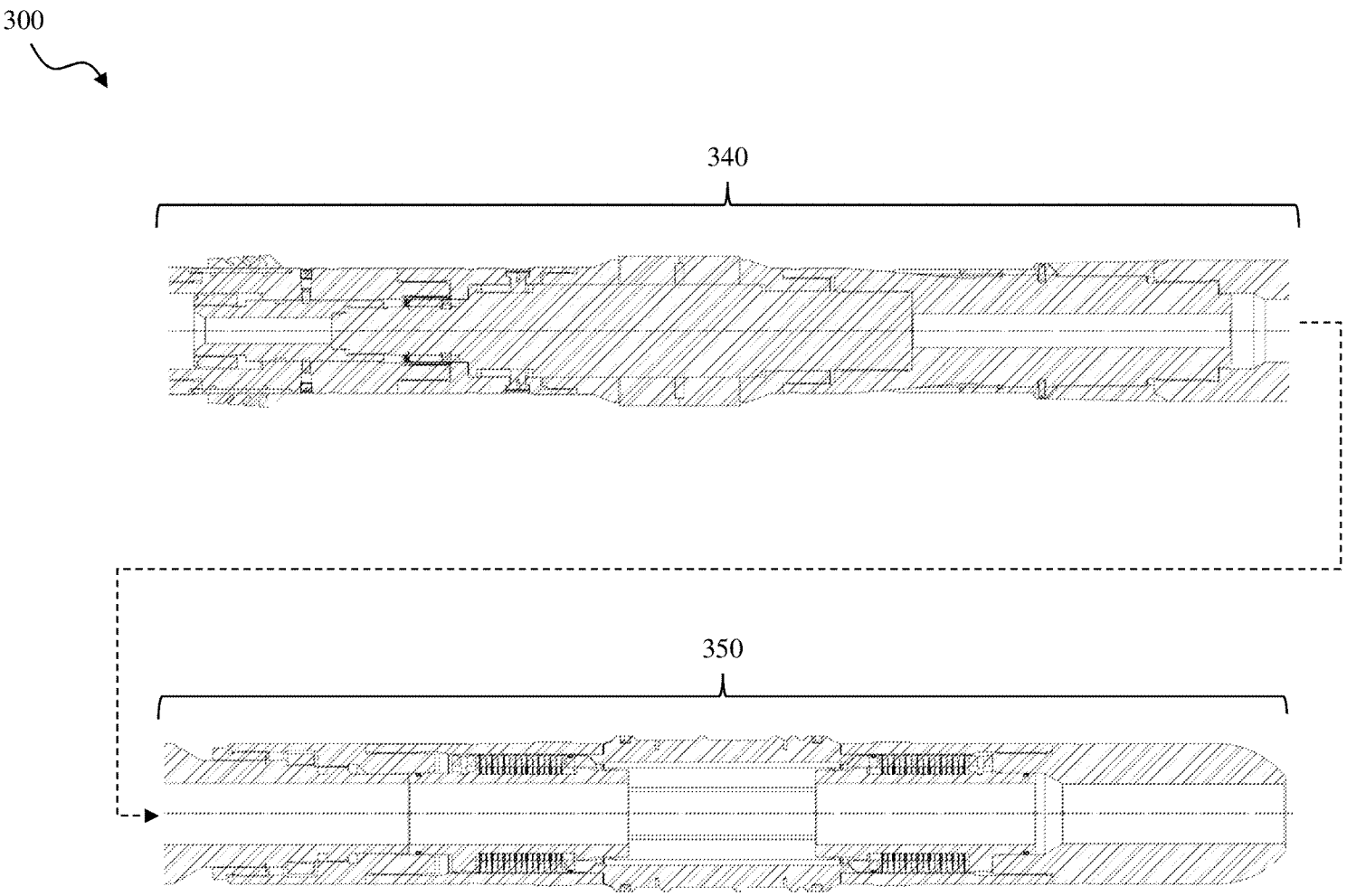
FIG. 3 illustrates an alternative embodiment of a sealing/anchoring subassembly, the sealing/anchoring subassembly including a sealing section and a latching element section designed and manufactured according to an alternative embodiment of the disclosure.
Figure 4A:
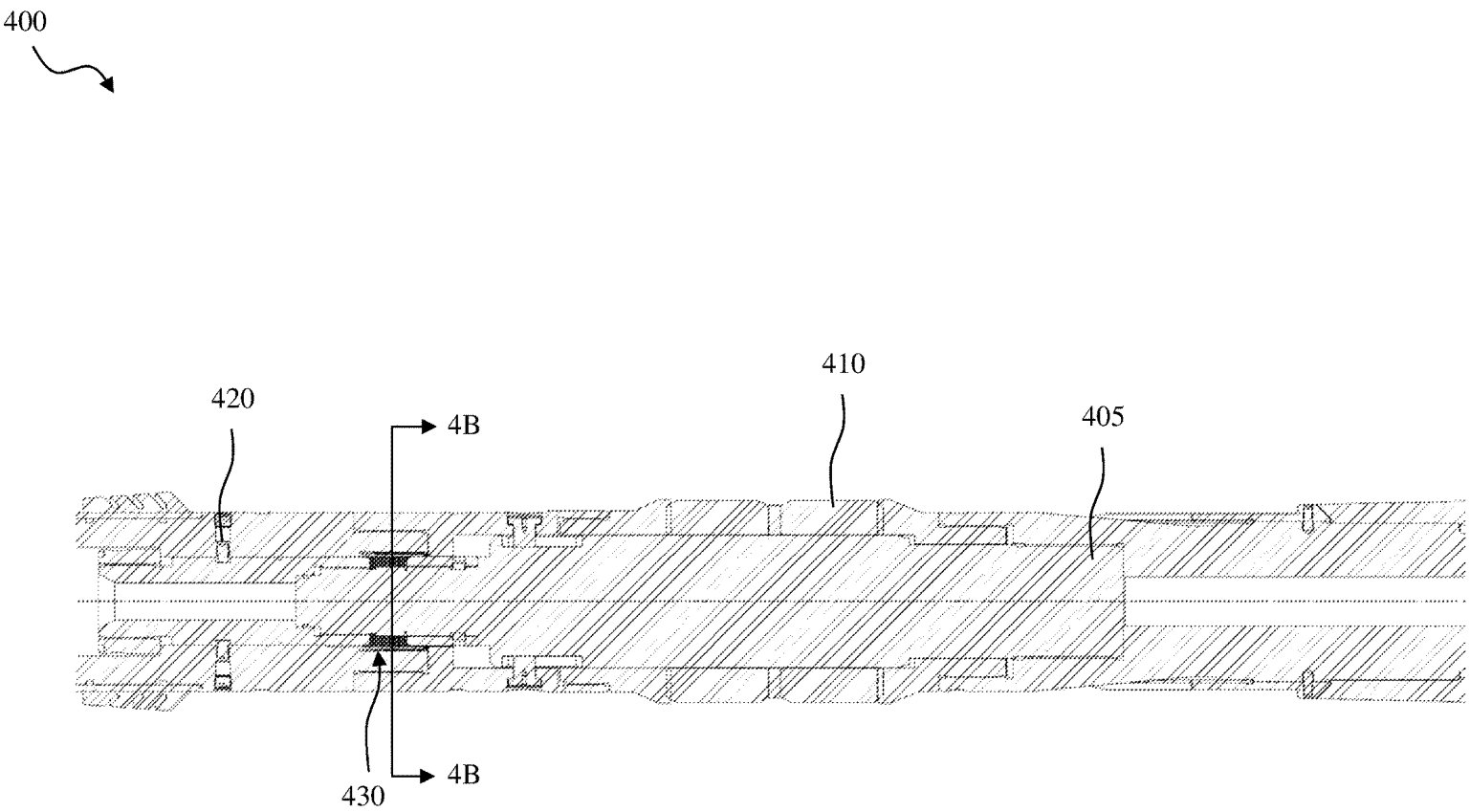
FIGS. 4A through 4D illustrate cross-sectional views of a portion of a sealing/anchoring subassembly designed and manufactured according to one or more embodiments of the disclosure.
Figure 4B:
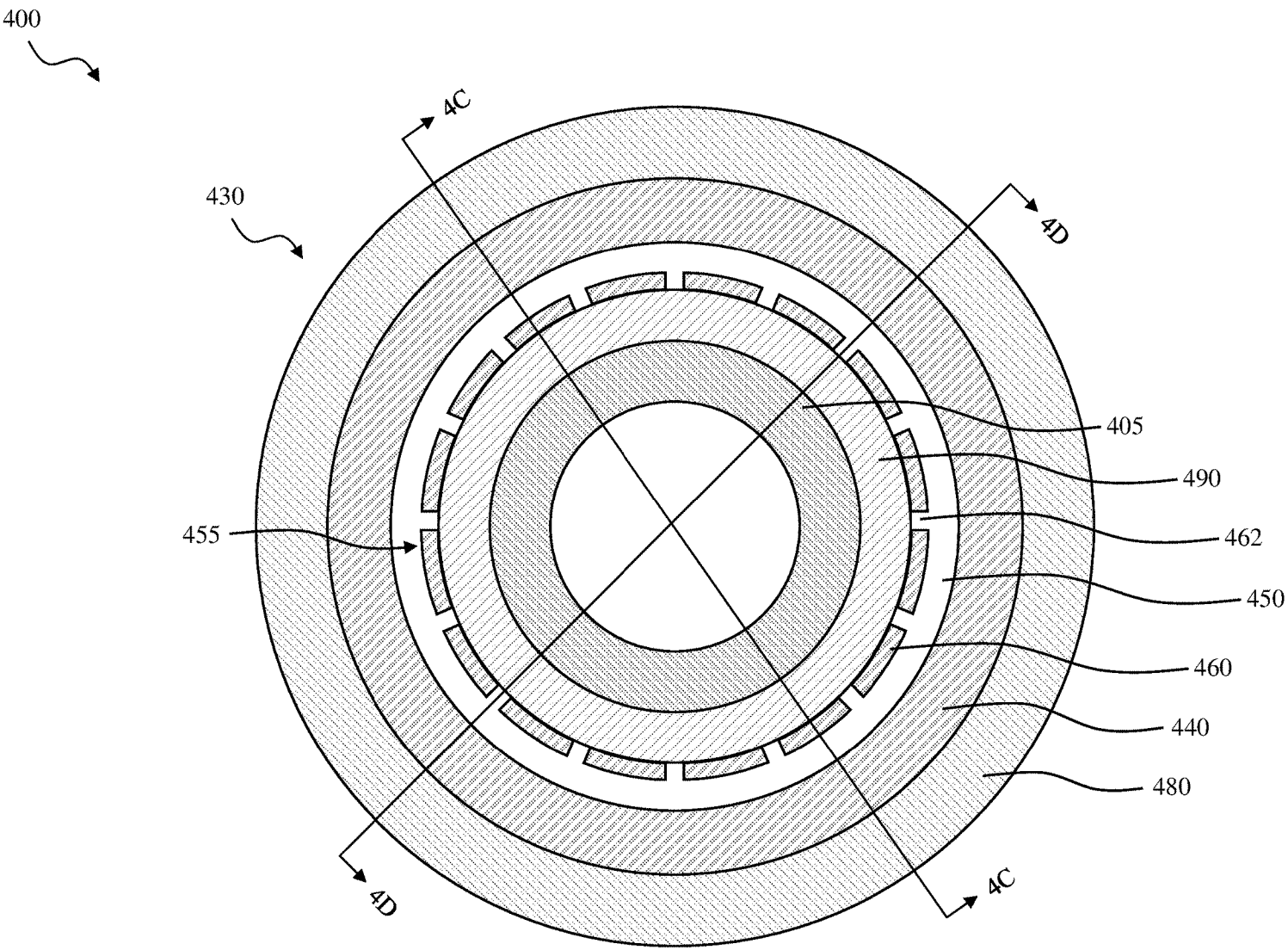
Figure 4C:
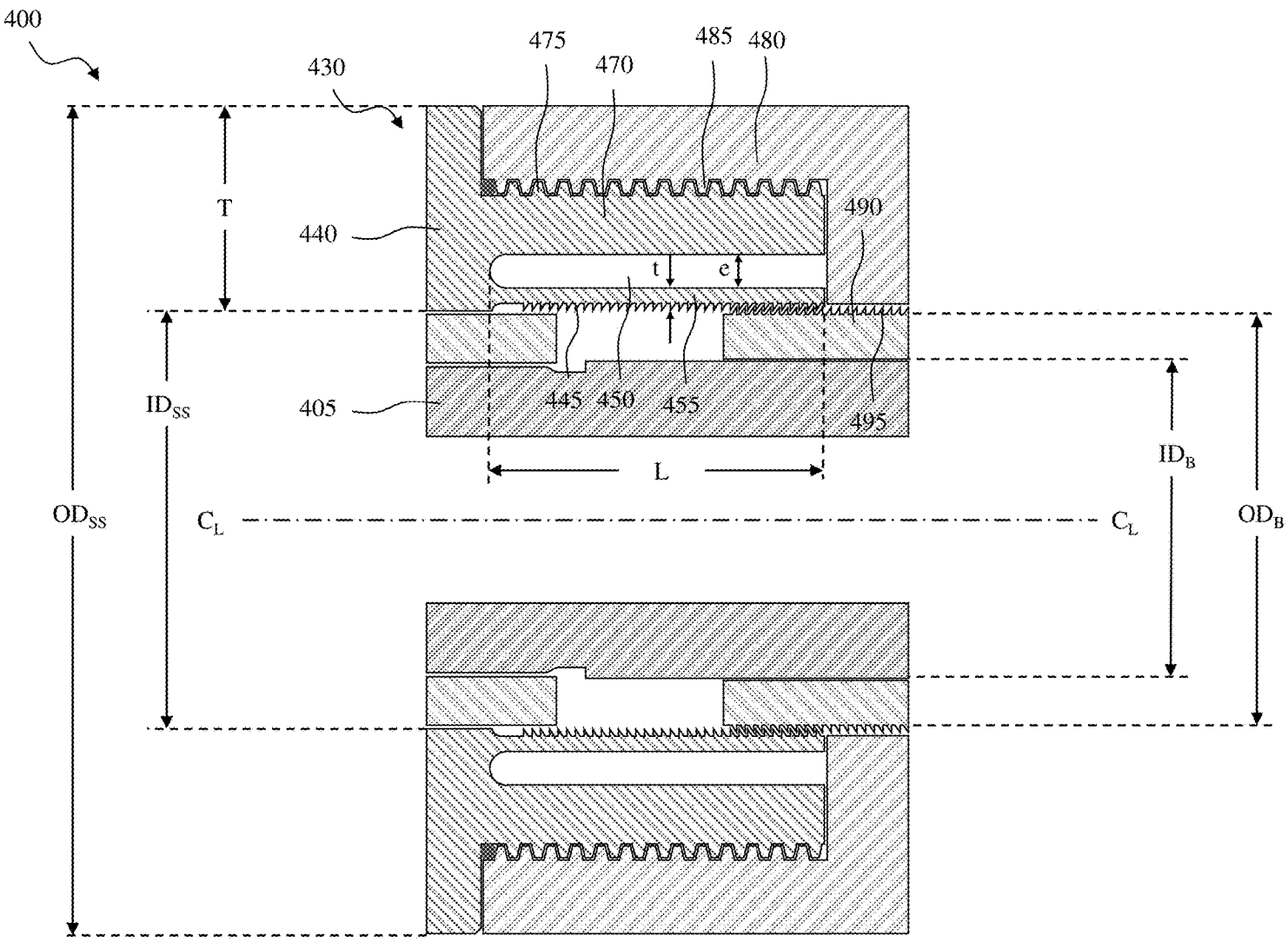
Figure 4D:
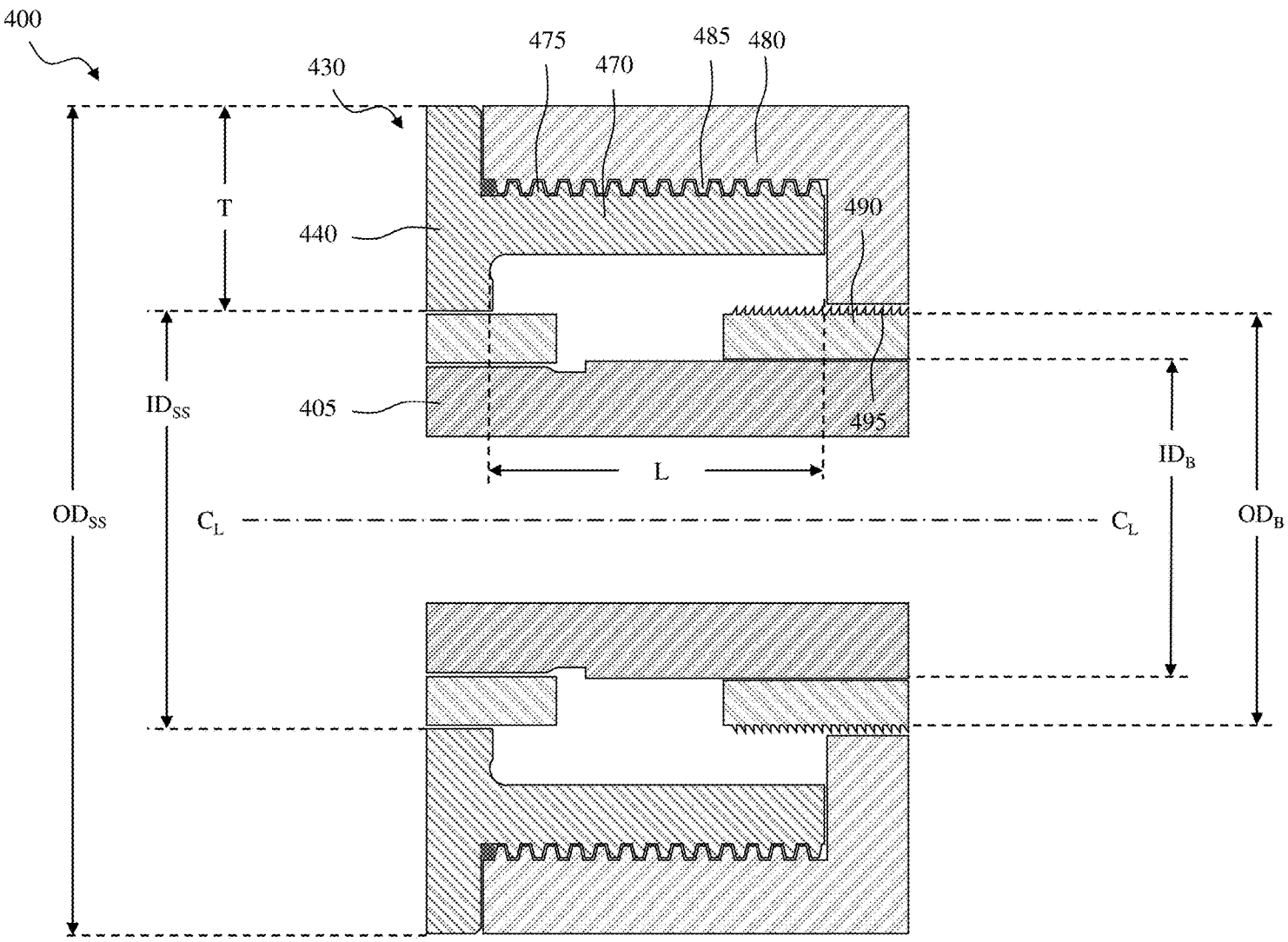

Turning to FIG. 3, illustrated is an alternative embodiment of a scaling/anchoring subassembly 300, the sealing/anchoring subassembly including a sealing section 340 and a latching element section 350 designed and manufactured according to an alternative embodiment of the disclosure. The sealing section 340, latching element section 350 and an orienting element section (not shown in FIG. 3) may be run in hole within a main wellbore, set, and then pressure tested, prior to a whipstock element section (not shown in FIG. 3) of the whipstock assembly being run in hole and attached with the sealing section 340 (e.g., engaged with the orienting element section attached to the sealing section 340). Notwithstanding, FIG. 3 illustrates the latching element section 350 in the engaged state, whereas the sealing section 340 is in the radially retracted state.

Turning to FIGS. 4A through 4D, illustrated are various different cross-sectional views of a portion of a scaling/anchoring subassembly 400 designed, manufactured and/or operated according to one or more embodiments of the disclosure. As is illustrated, in one or more embodiments, the sealing/anchoring subassembly 400 includes a mandrel 405 having a scaling/anchoring element 410 positioned thereabout. In at least one embodiment, the sealing/anchoring element 410 is configured to move between a radially retracted state and a radially expanded state.

The sealing/anchoring subassembly 400, in the illustrated embodiment, additionally includes one or more setting shear features 420. In one or more embodiments, the one or more setting shear features 420 are used to hold the sealing/anchoring element 410 in its radially retracted state while running in hole, and thus allowing a flow path for cleaning the wellbore.

The sealing/anchoring subassembly 400, in one or more embodiments, additionally includes a ratch latch body 430 designed, manufactured and/or operated according to one or more embodiments of the disclosure. In the illustrated embodiment, the ratch latch body 430 is configured to move and/or hold the sealing/anchoring element 410 in the radially expanded state. The ratch latch body 430 includes, in one or more embodiments, a stroke sleeve 440 having a stroke sleeve outer diameter ($OD_{SS}$) and a stroke sleeve inner diameter ($ID_{SS}$). Further to the embodiment of FIGS. 4A through 4D, the stroke sleeve inner diameter ($ID_{SS}$) has a plurality of stroke sleeve teeth 445 disposed thereon.

The ratch latch body 430, in the embodiment shown, further includes a circumferential slot 450 formed within a thickness (T) of the stroke sleeve 440 between the stroke sleeve outer diameter ($OD_{SS}$) and the stroke sleeve inner diameter ($ID_{SS}$). In accordance with this embodiment, the slot 450 forms an integrated locker ring 455, as discussed above. Further to this embodiment, in one or more embodiments the integrated locker ring 455 includes (n) segments 460 separated by spacings 462 around its circumference, the (n) segments 460 configured to allow the integrated locker ring 455 to radially deform via a cantilever action. In at least one embodiment, (n) is at least two. In yet another embodiment. (n) is at least three, at least four, at least six, or twelve or more. In at least one other embodiment, the number (n) of segments 460 around the circumference, the slot opening width (e), the locker ring thickness (t) and the length of the slot (L) may all be properly selected to tailor the sealing/anchoring subassembly 400 for a given geometry and/or setting load.

In at least one embodiment, the stroke sleeve 440 additionally includes a pin section 470 having a plurality of pin threads 475, the pin threads 475 configured to engage with related box threads 485 in a box section 480 of the sealing/anchoring subassembly 400. Further to the embodiment shown in FIGS. 4A through 4D, the slot 450 may be in the pin section 470 of the stroke sleeve 440.

The ratch latch body 430, in one or more embodiments, may further include a base 490 having a base outer diameter ($OD_B$) and a base inner diameter ($ID_B$). The base outer diameter ($OD_B$), in the illustrated embodiment, has a plurality of base teeth 495 disposed thereon. Accordingly, in at least one embodiment the stroke sleeve teeth 445 and the base teeth 495 are configured to directly ratchet along one another to hold the sealing/anchoring element 410 in the radially expanded state. For example, in at least one embodiment the stroke sleeve 440 moves while the base 490 remains fixed (e.g., a fixed base). For example, the base 490 could be fixed (e.g., permanently fixed or releasably fixed) to the mandrel 405 in one or more embodiments. In other embodiments, it may be preferable to have the stroke sleeve 440 remain fixed, while the base 490 moves relative to the fixed stroke sleeve 440. Thus, in accordance with one embodiment of the disclosure, the integrated locker ring 455 is effectively decoupled from a radially outer portion of the stroke sleeve 440 (e.g., near the pin threads 475 along the stroke sleeve outer diameter ($OD_{SS}$)). Moreover, in the embodiment of FIGS. 4A through 4D, the scaling/anchoring subassembly 400 does not include an independent body lock ring, as discussed above.

Figure 5A:
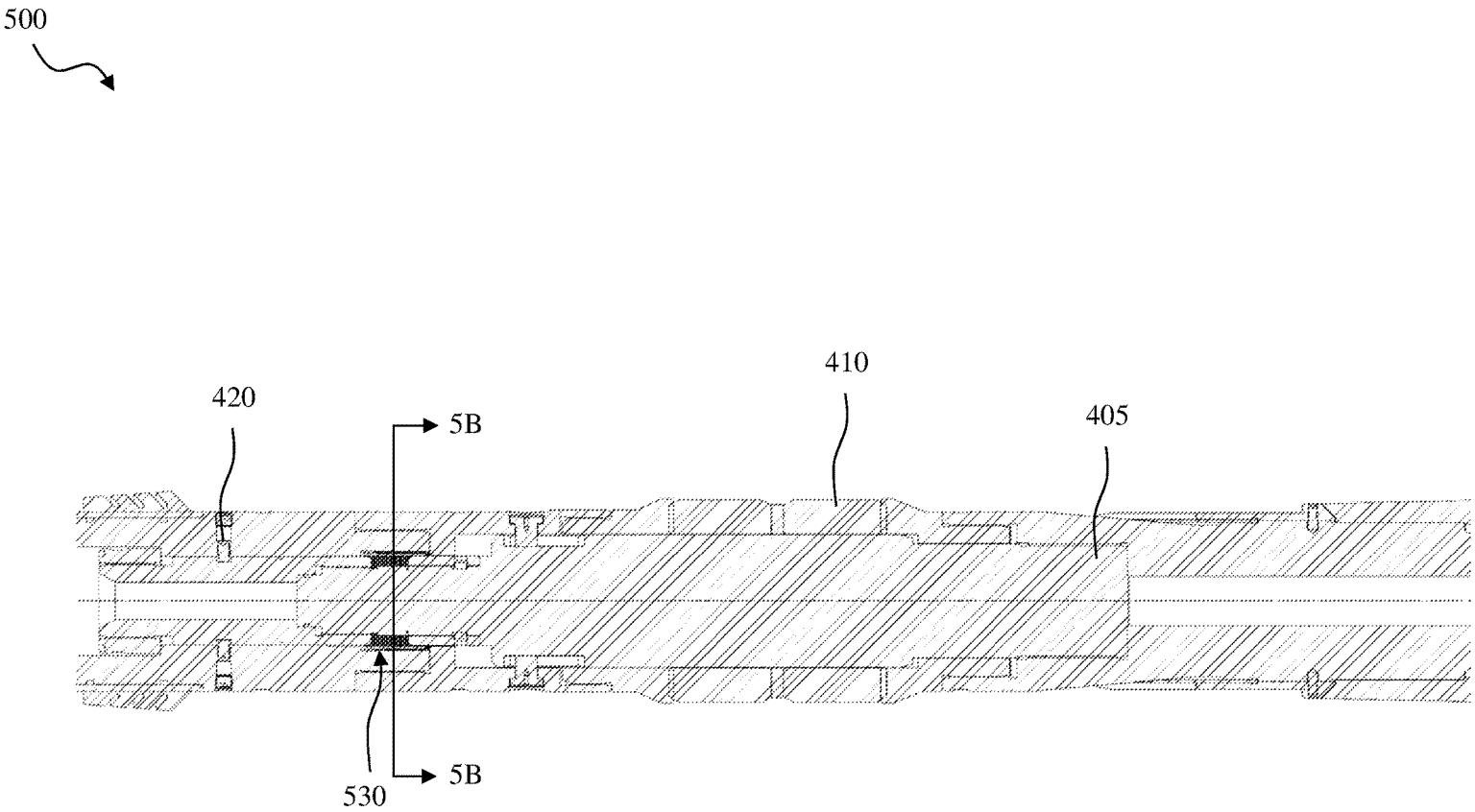
FIGS. 5A through 5G illustrate cross-sectional views of a portion of a sealing/anchoring subassembly designed and manufactured according to one or more alternative embodiments of the disclosure.
Figure 5B:
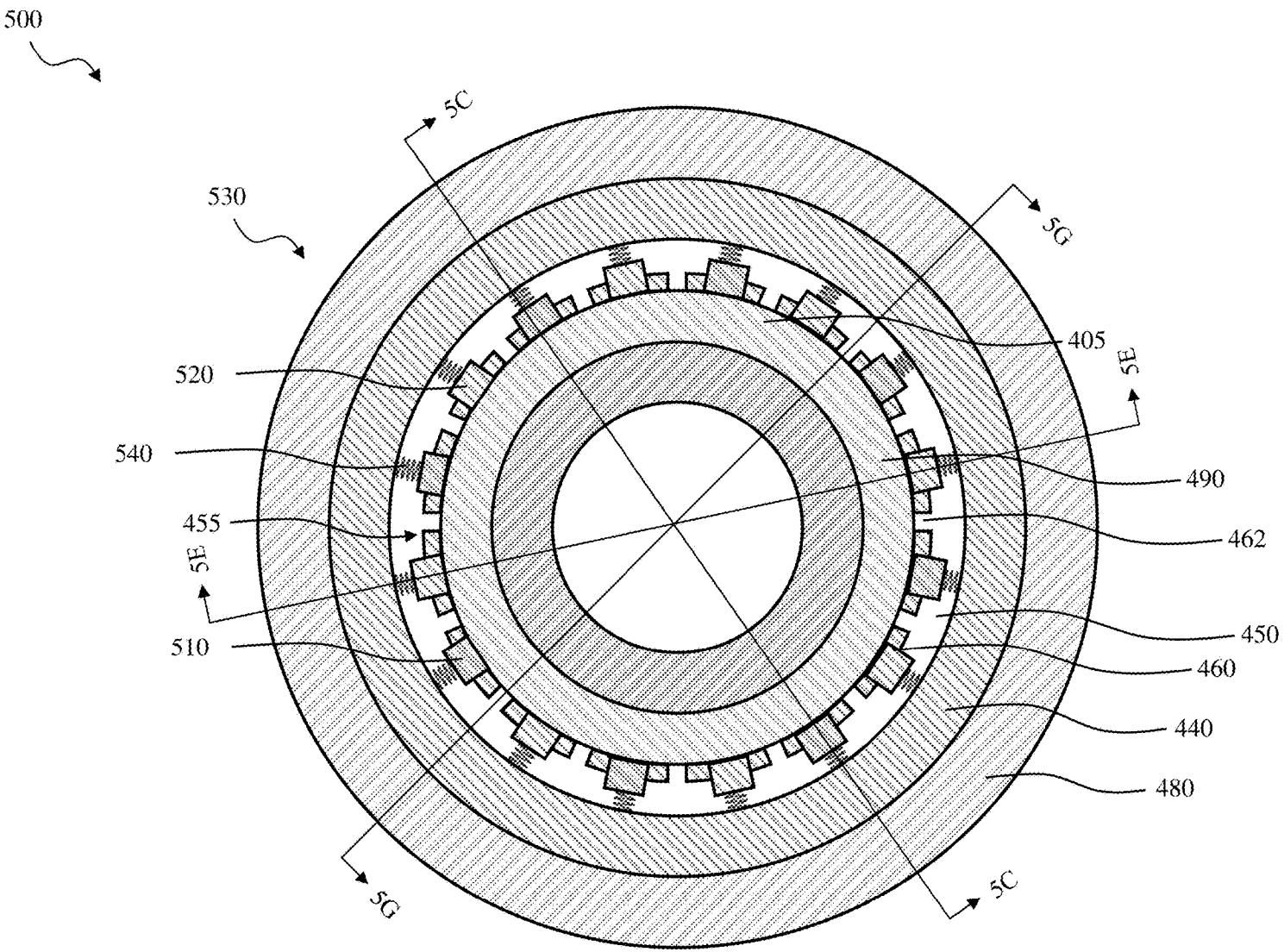
Figure 5C:
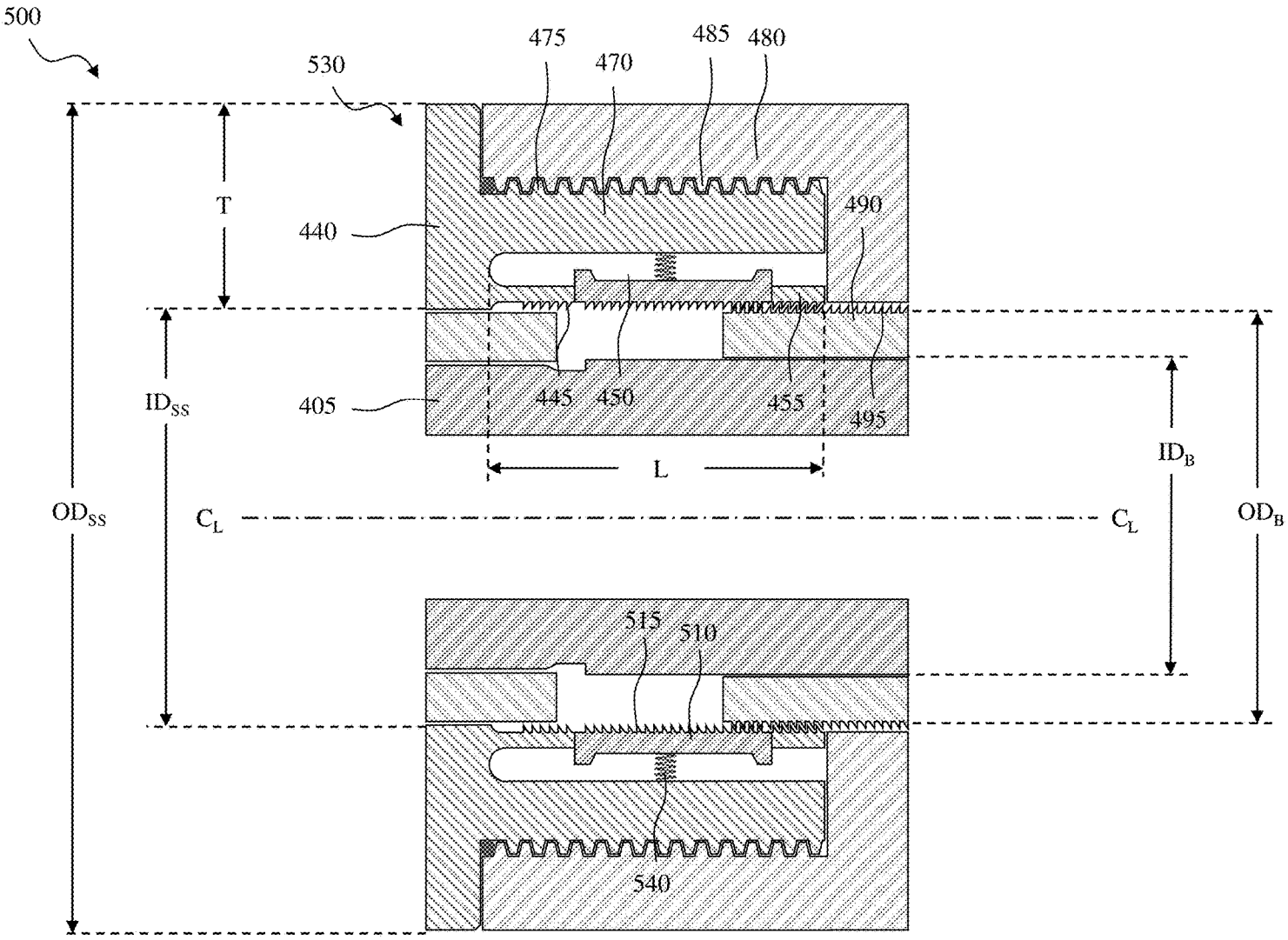
Figure 5D:
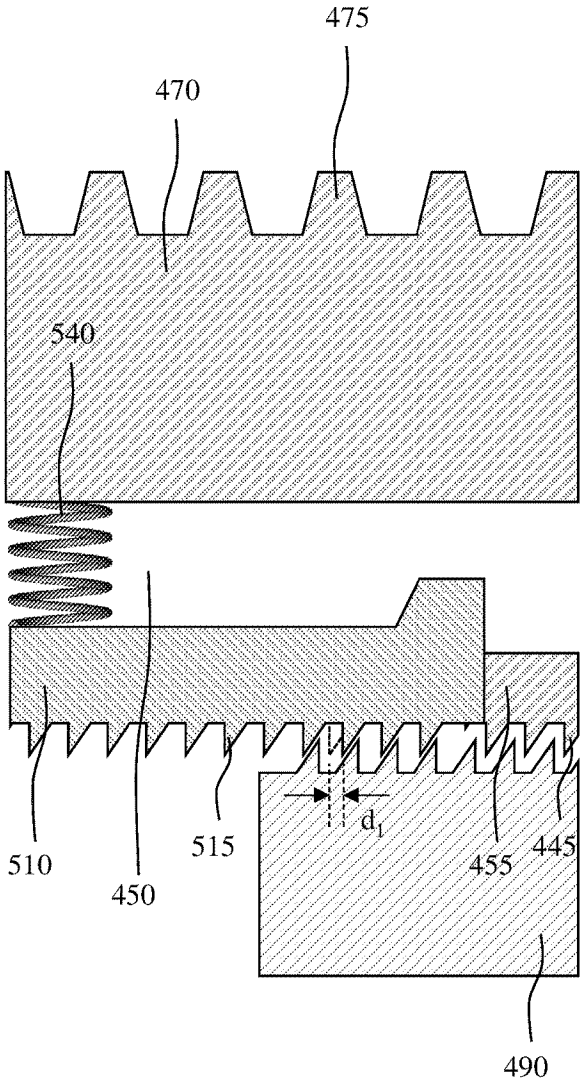
Figure 5E:
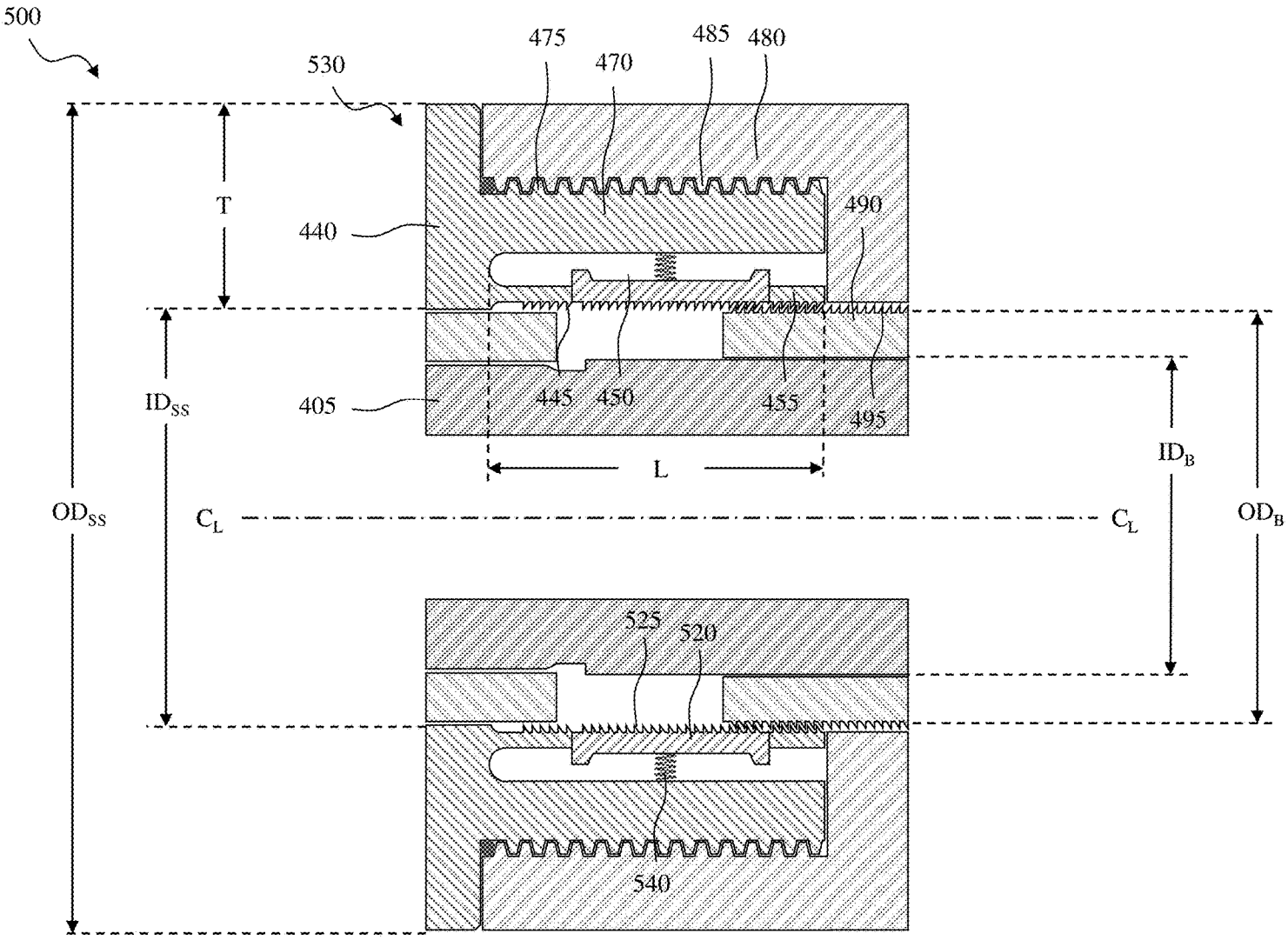

Turning to FIGS. 5A through 5G, illustrated are cross-sectional views of a scaling/anchoring subassembly 500 designed, manufactured and/or operated according to an alternative embodiment of the disclosure. The scaling/anchoring subassembly 500 is similar in many respects to the sealing/anchoring subassembly 400 illustrated in FIGS. 4A through 4D above. Accordingly, like reference numbers have been used to indicate similar, if not identical, features. The scaling/anchoring subassembly 500 differs, for the most part, from the scaling/anchoring subassembly 400, in that it includes additional/different features for its ratch latch body 530. For example, in the embodiment of FIGS. 5A through 5G, the ratch latch body 530 further includes first retaining blocks 510 positioned in first openings in the (n) segments 460, the first retaining blocks 510 having first retaining block teeth 515 that are offset from the stroke sleeve teeth 445 a first direction by a first offset distance ($d_1$). For example, as shown in FIG. 5D the base teeth 495 have a fixed pitch, and in this embodiment the stroke sleeve teeth 445 are centered upon the base teeth 495. However, as shown, the first retaining block teeth 515 are offset from the stroke sleeve teeth 445 (e.g., in relation to the fixed pitch base teeth 495) by the first offset distance ($d_1$). Furthermore, the first retaining block teeth 515 are offset in a first direction (e.g., to the right in this embodiment). In at least one embodiment, the first offset distance ($d_1$) ranges from $1/8^{th}$ of a thread to ½ of a thread.

Figure 5F:
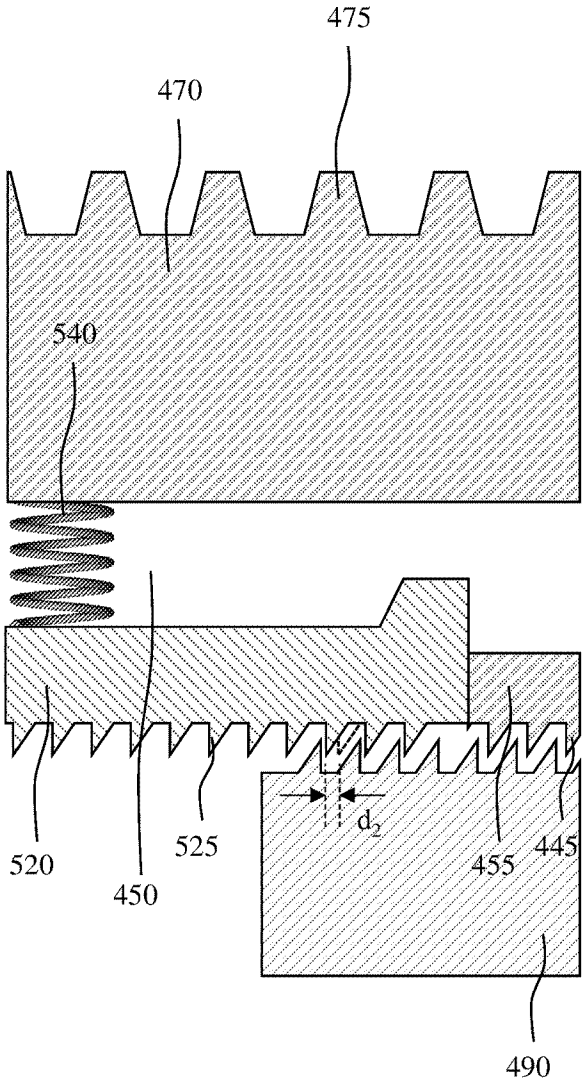
Figure 5G:
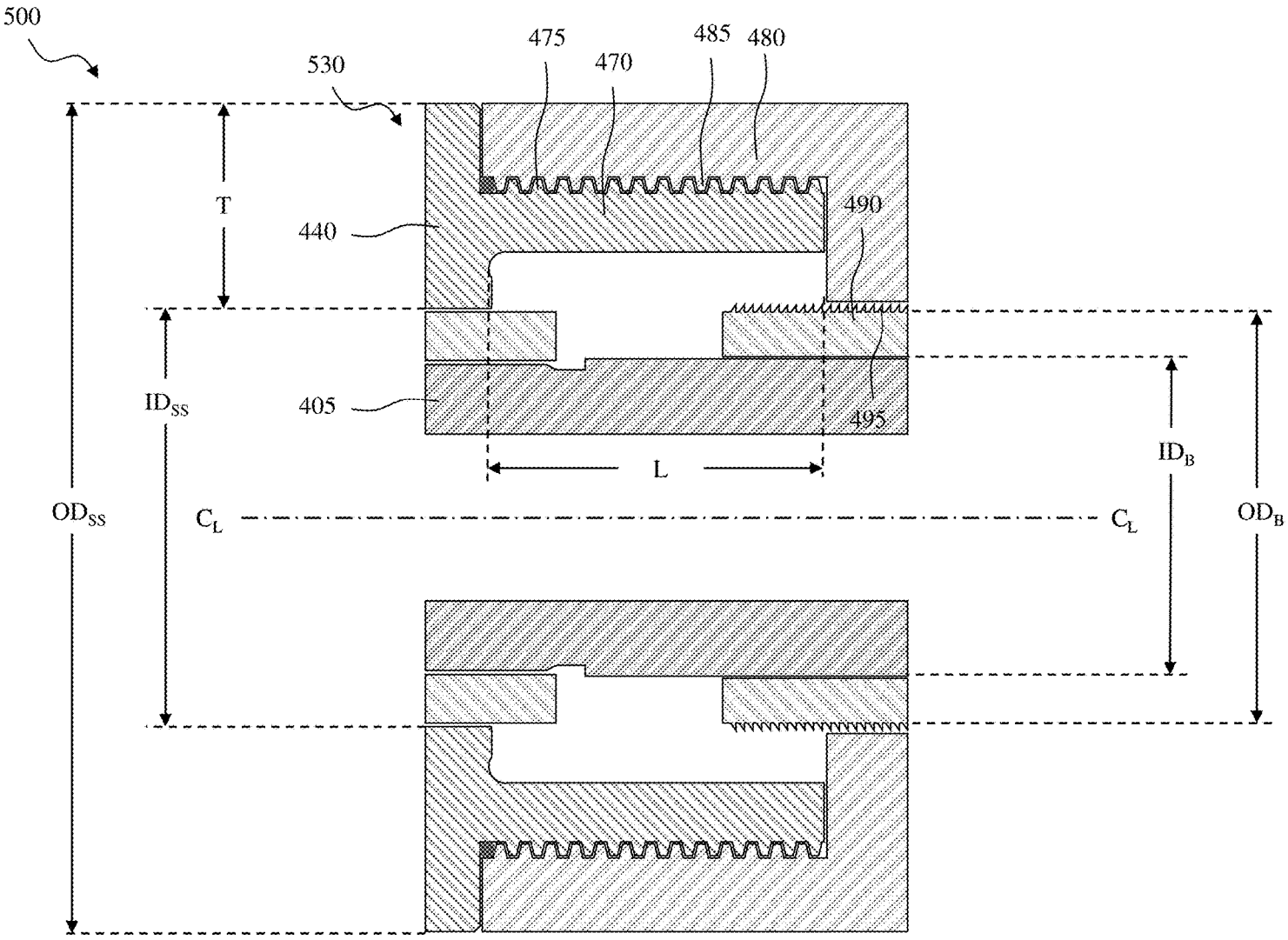
Figure 6A:
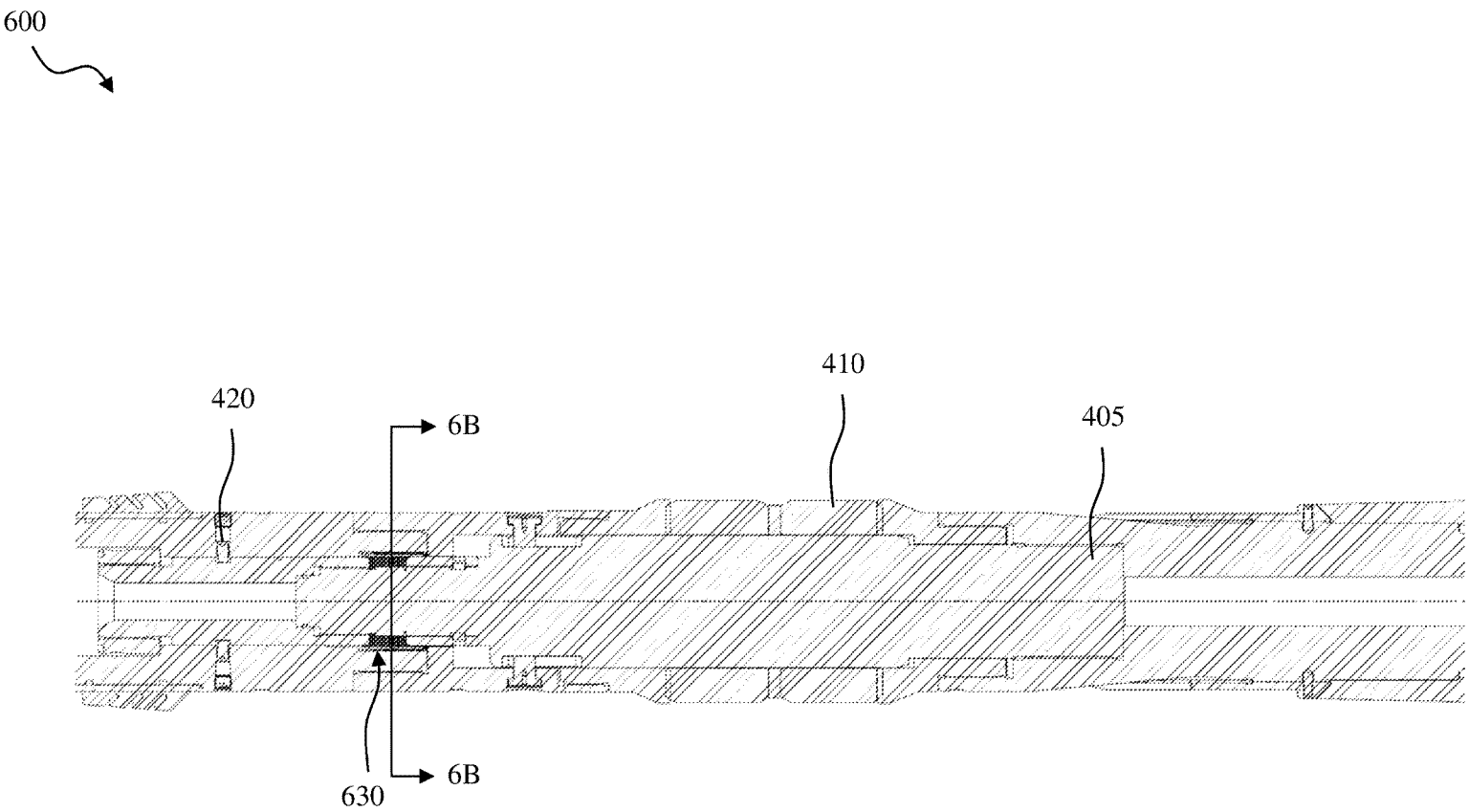
FIGS. 6A through 6D illustrate cross-sectional views of a portion of a sealing/anchoring subassembly designed and manufactured according to one or more alternative embodiments of the disclosure.
Figure 6B:
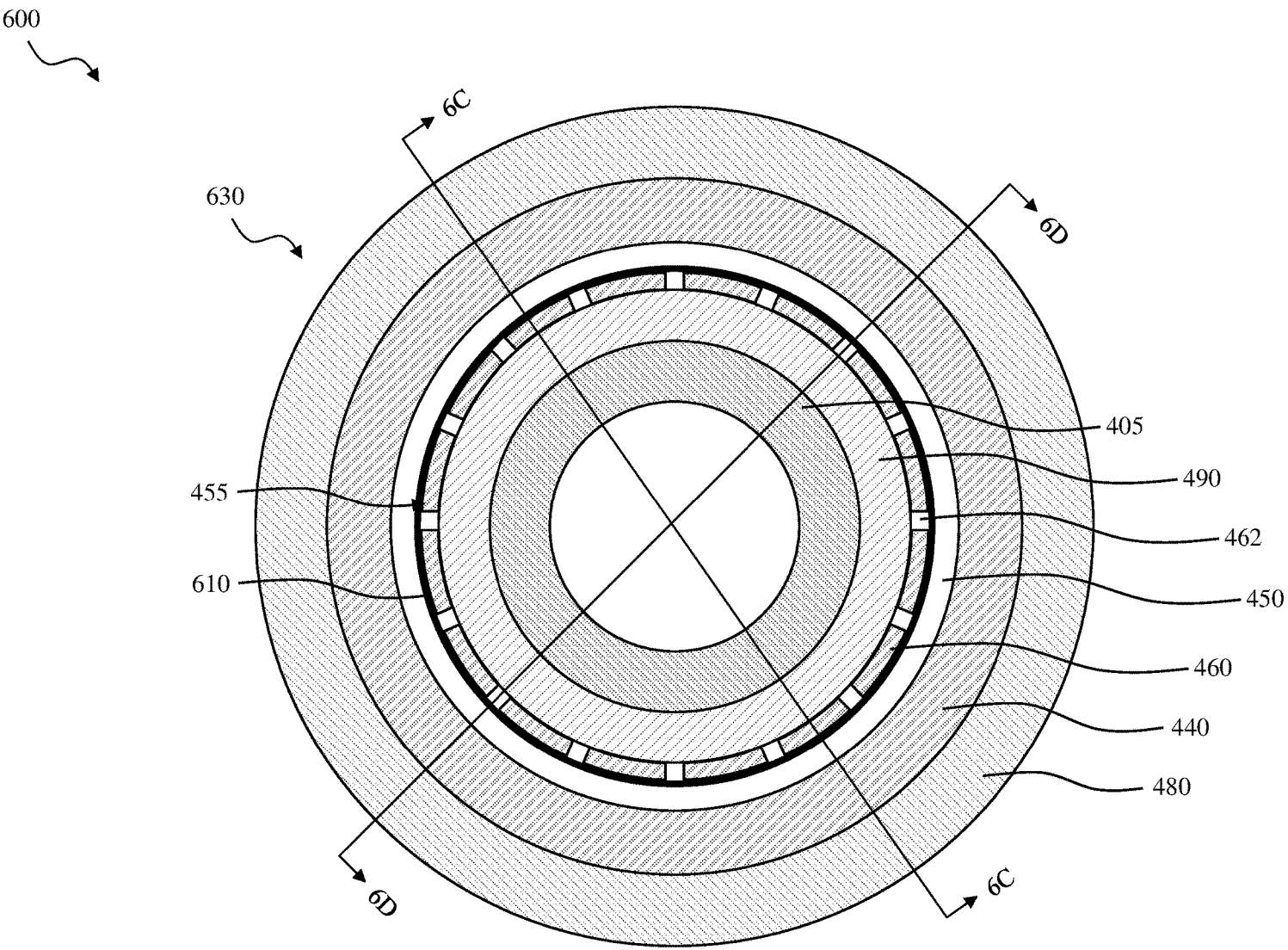
Figure 6C:
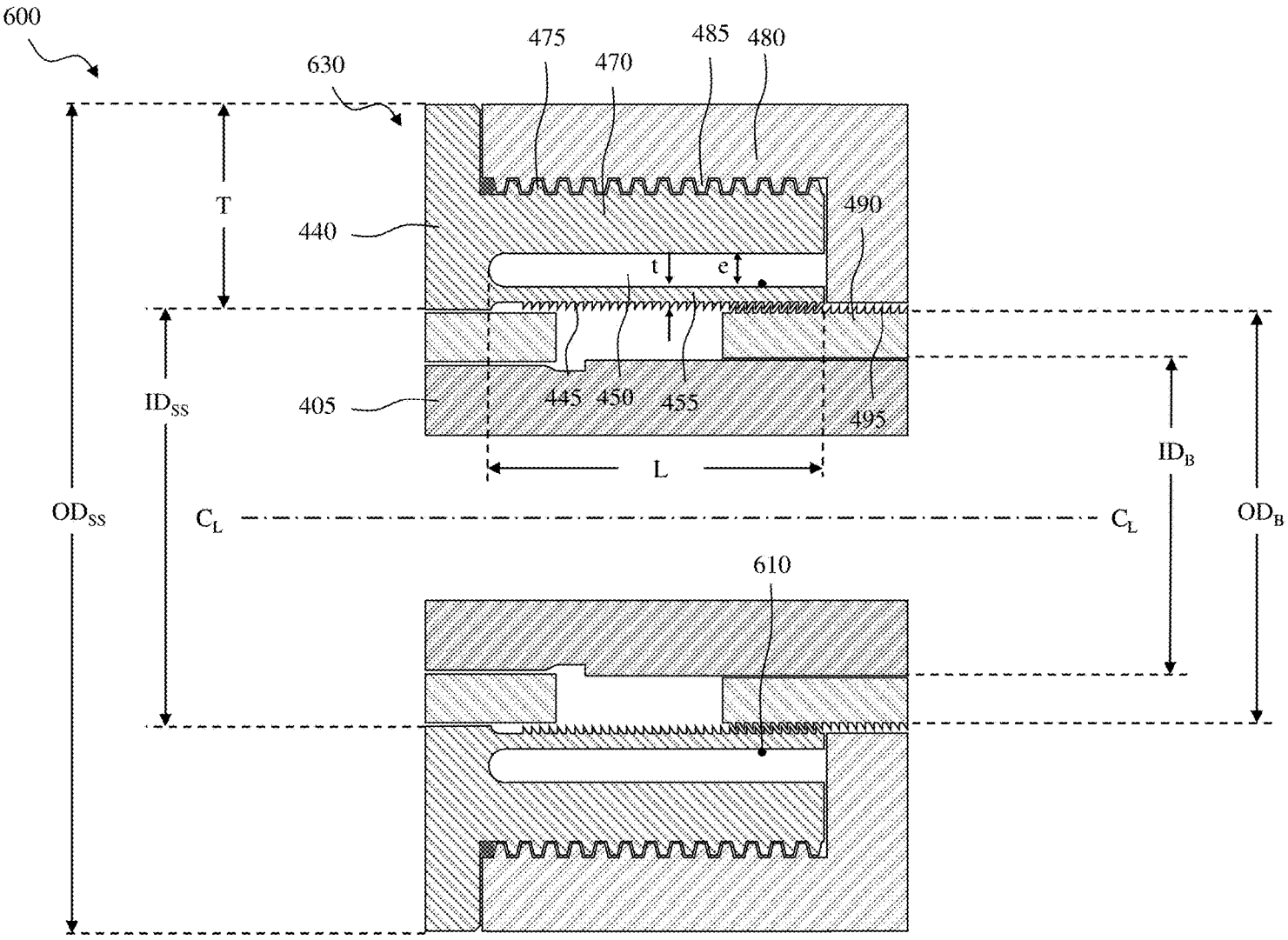
Figure 6D:
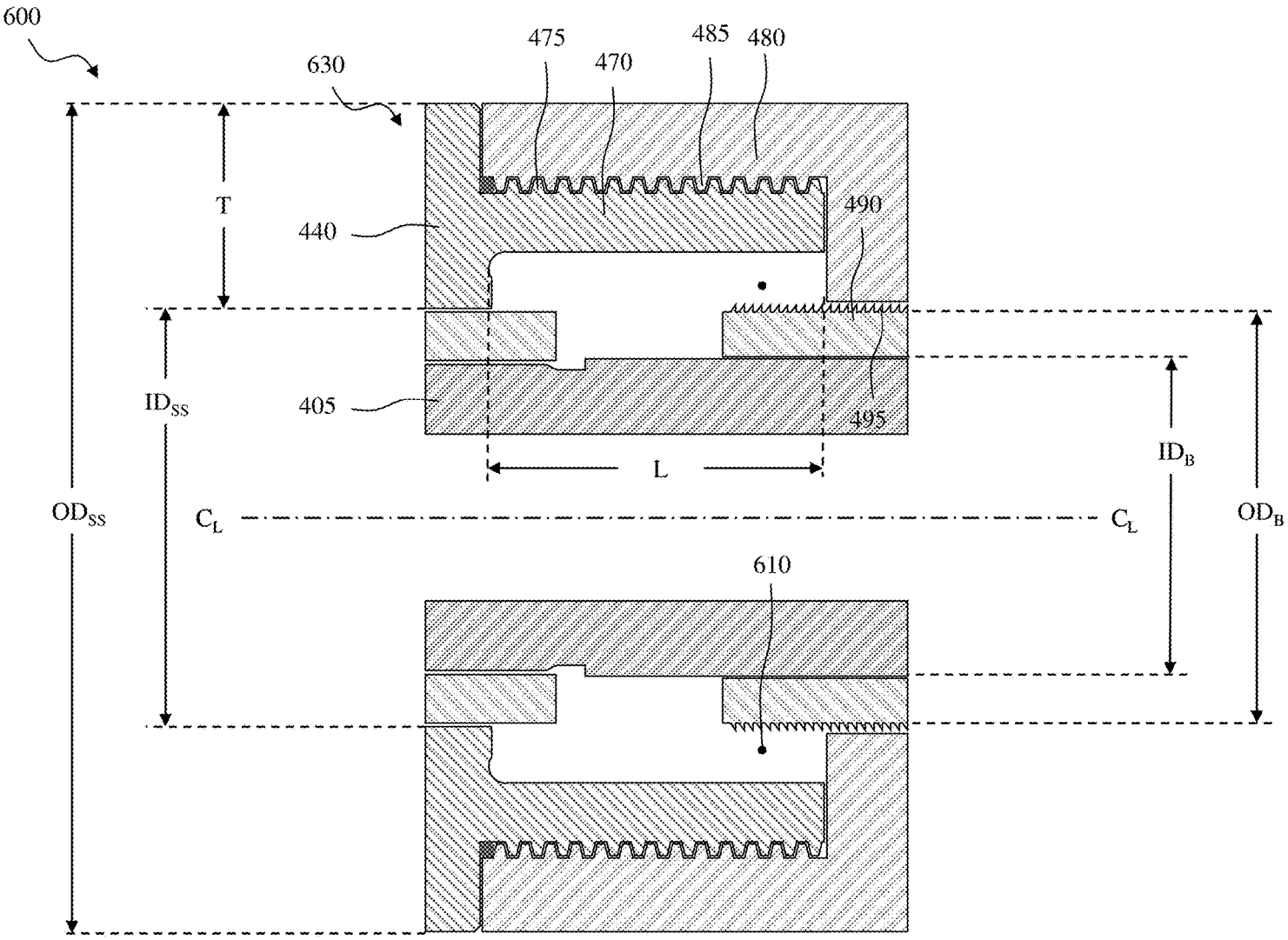
Figure 7A:
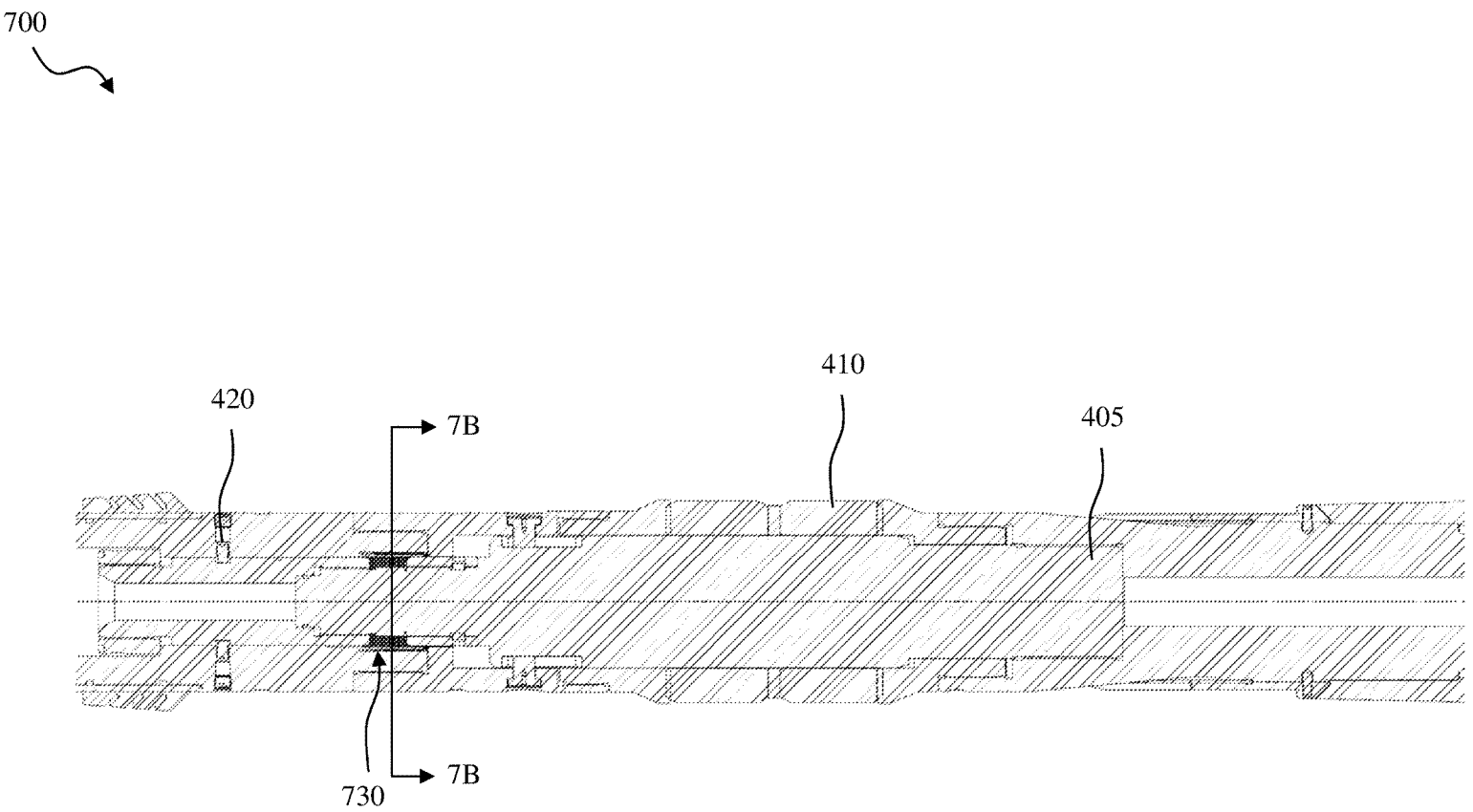
FIGS. 7A through 7D illustrate cross-sectional views of a portion of a scaling/anchoring subassembly designed and manufactured according to one or more alternative embodiments of the disclosure.
Figure 7B:
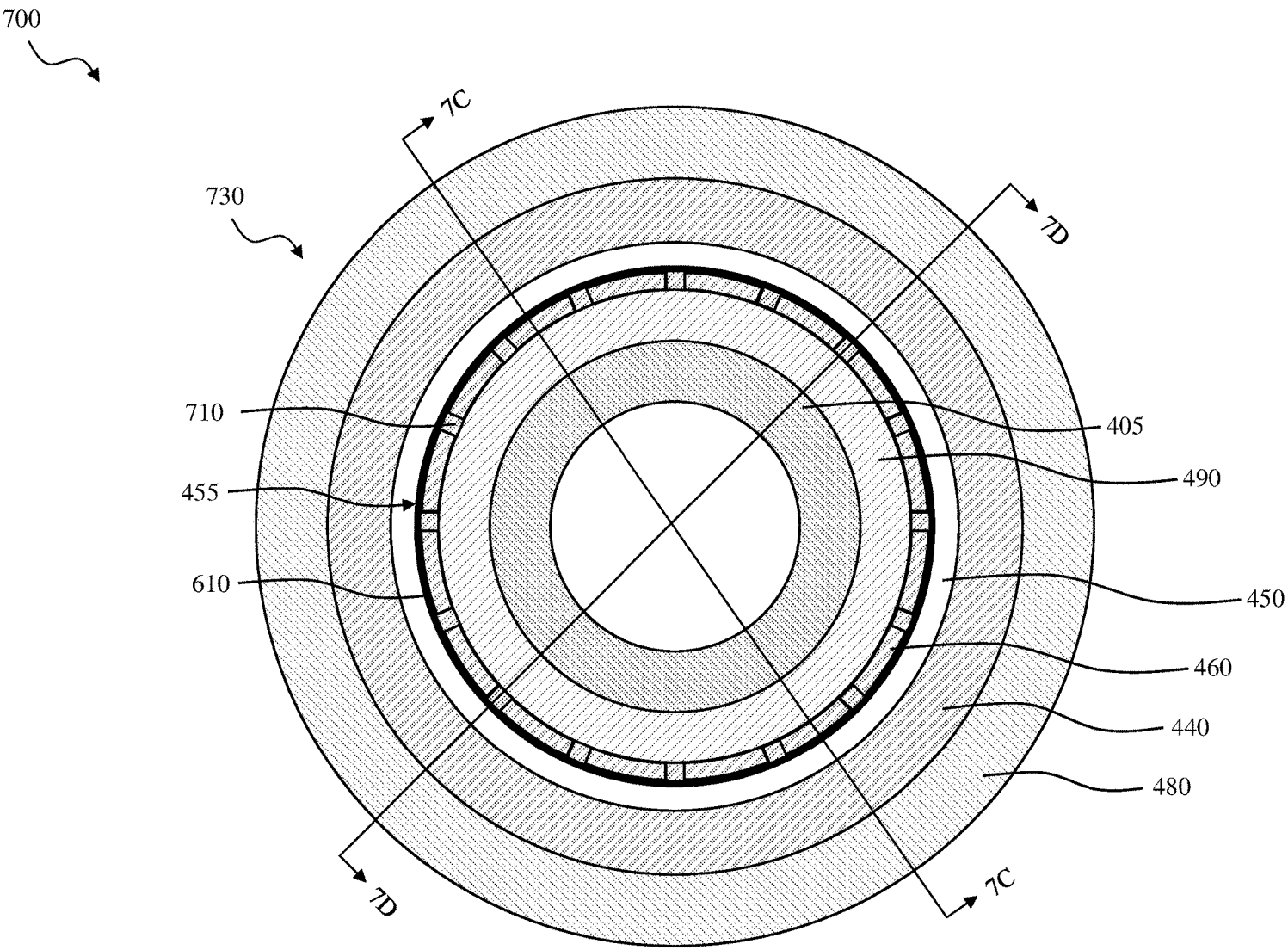
Figure 7C:
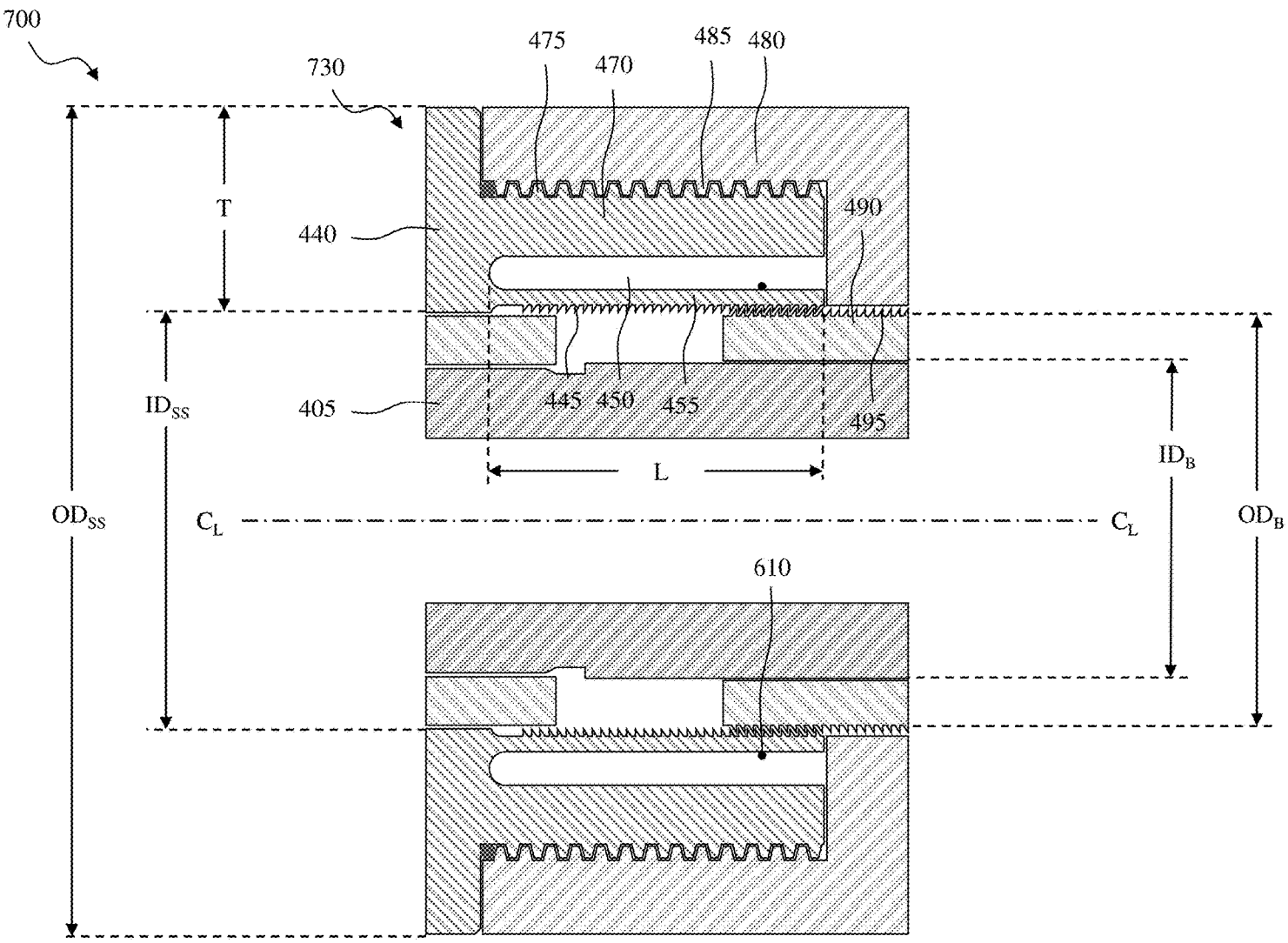
Figure 7D:
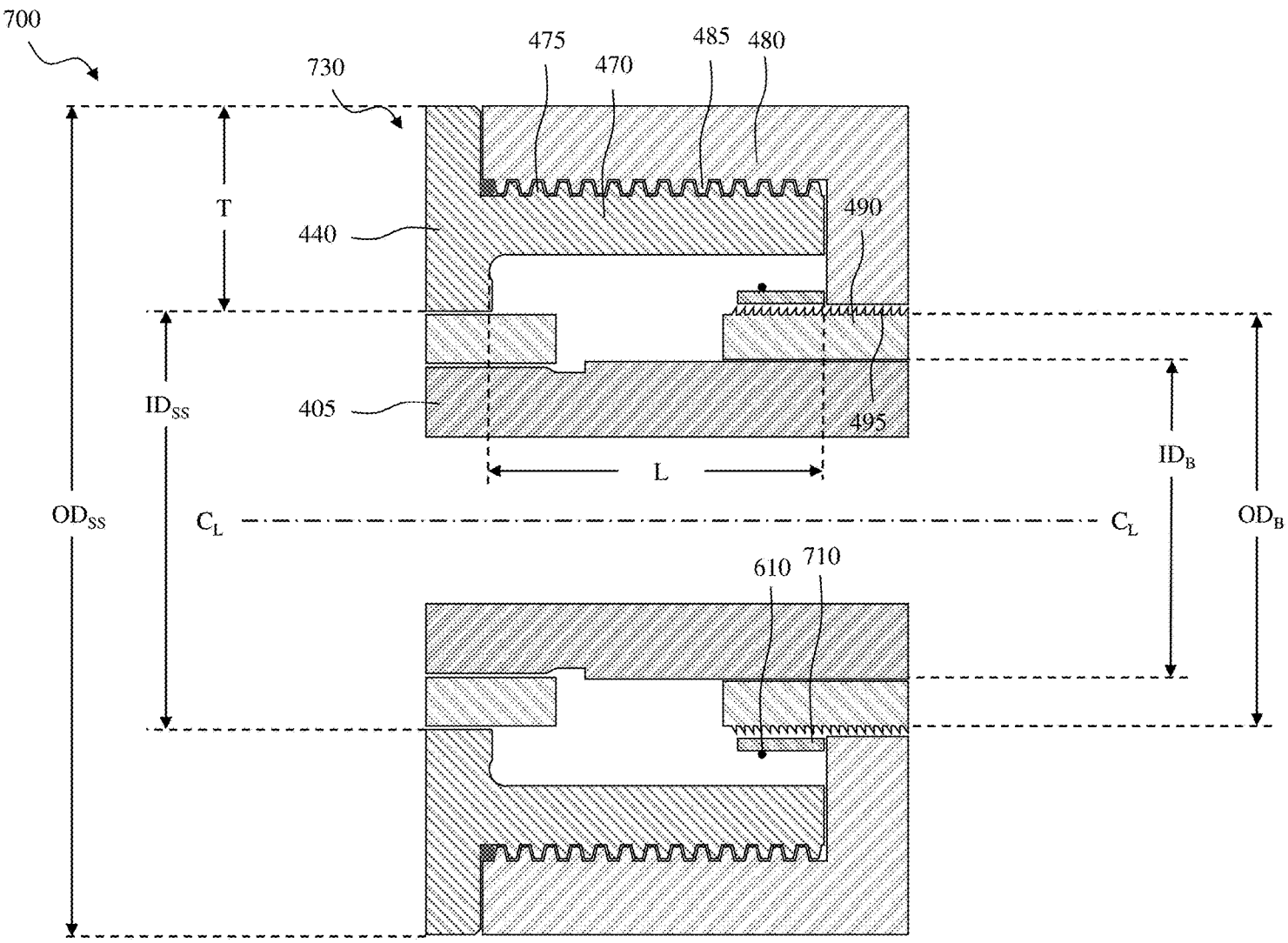
Figure 8A:
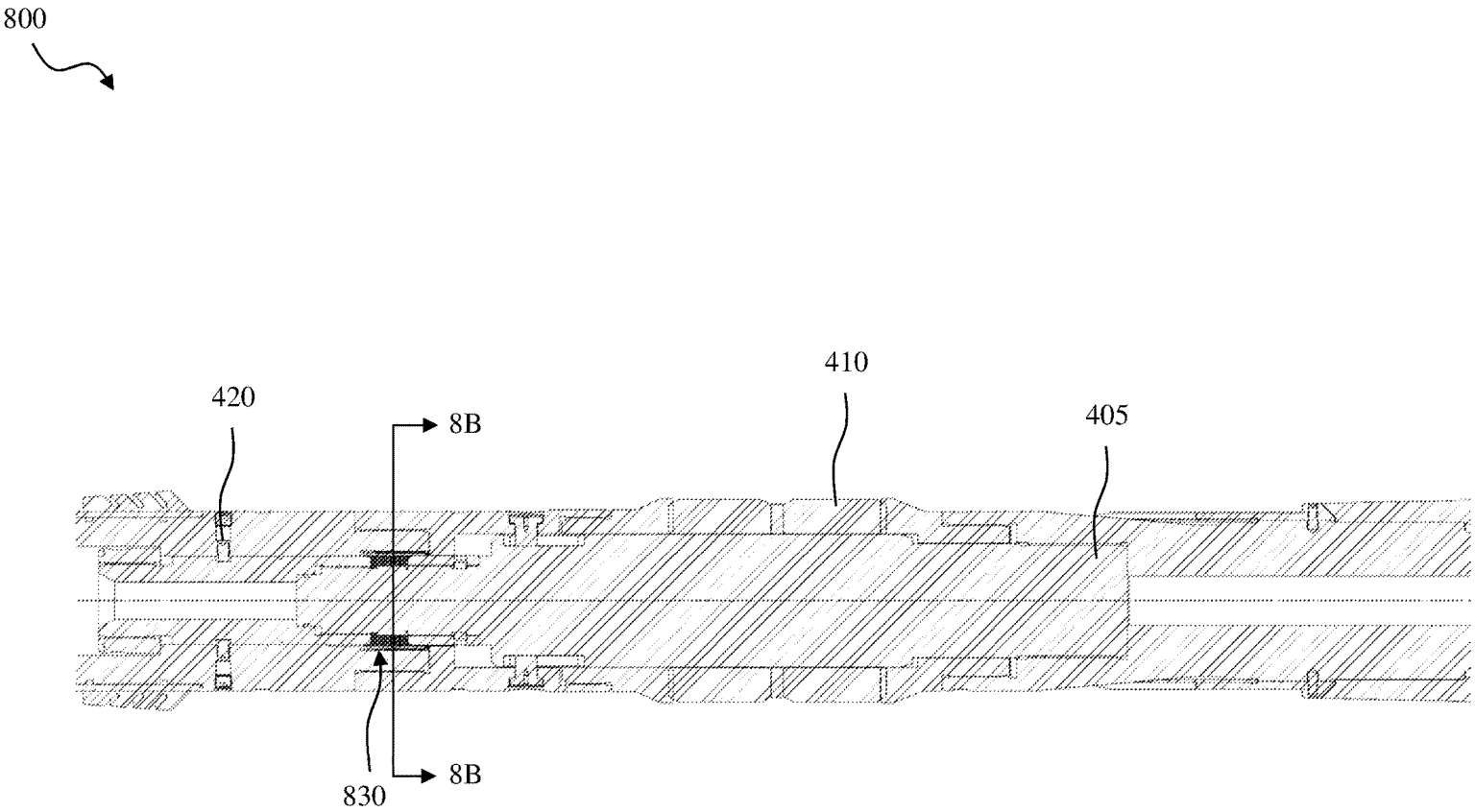
FIGS. 8A through 8D illustrate cross-sectional views of a portion of a sealing/anchoring subassembly designed and manufactured according to one or more alternative embodiments of the disclosure.
Figure 8B:
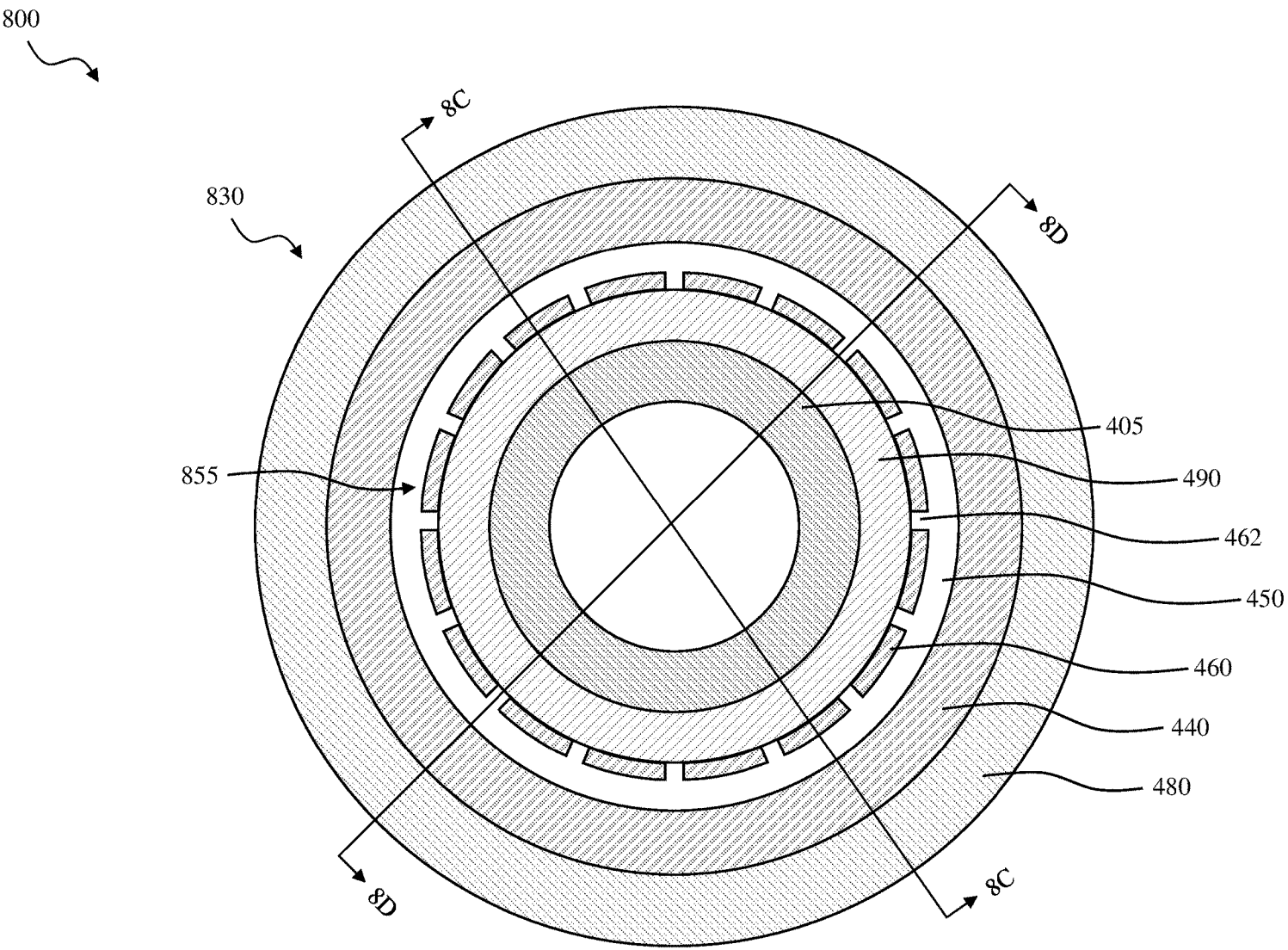
Figure 8C:
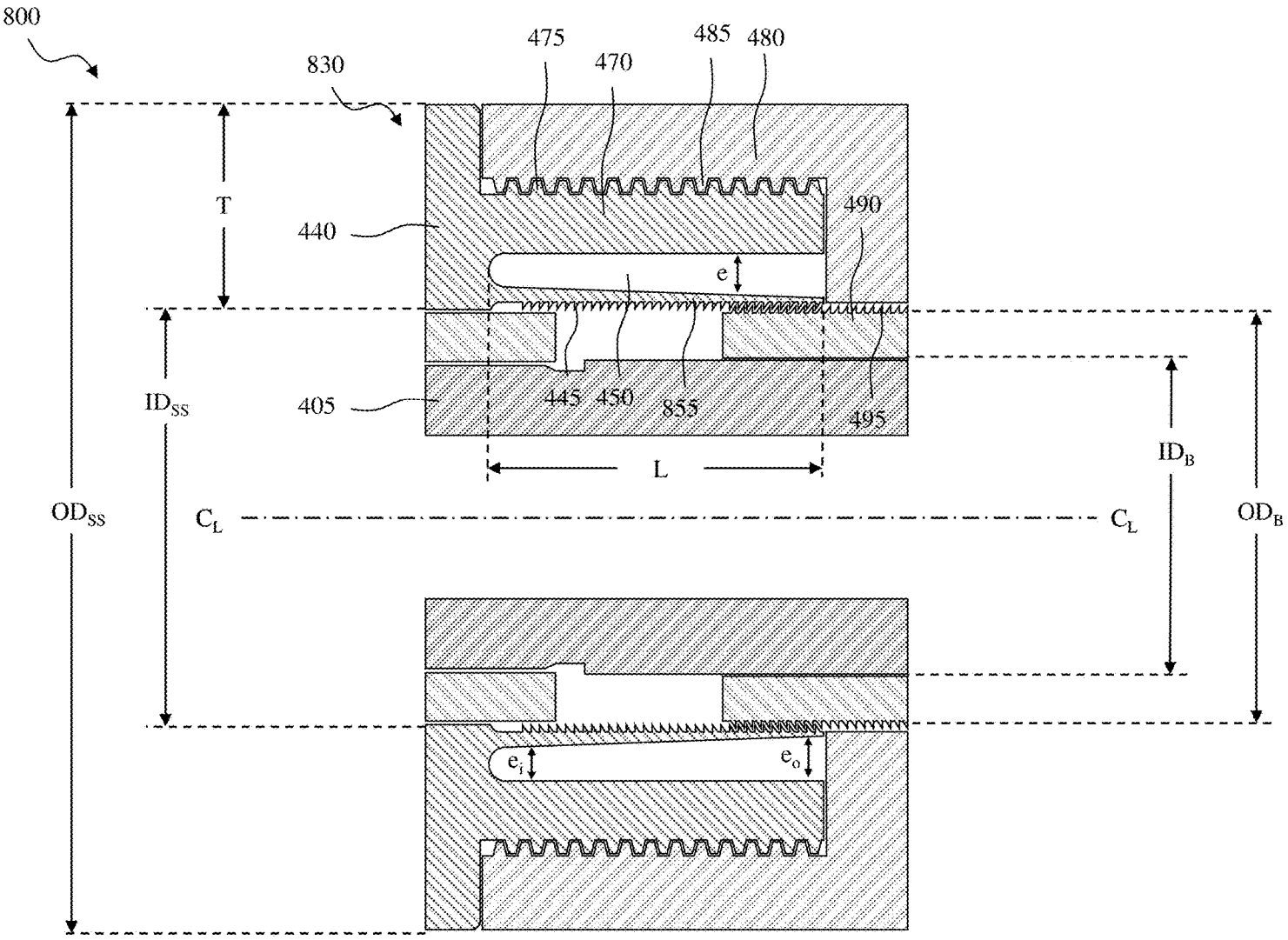
Figure 8D:
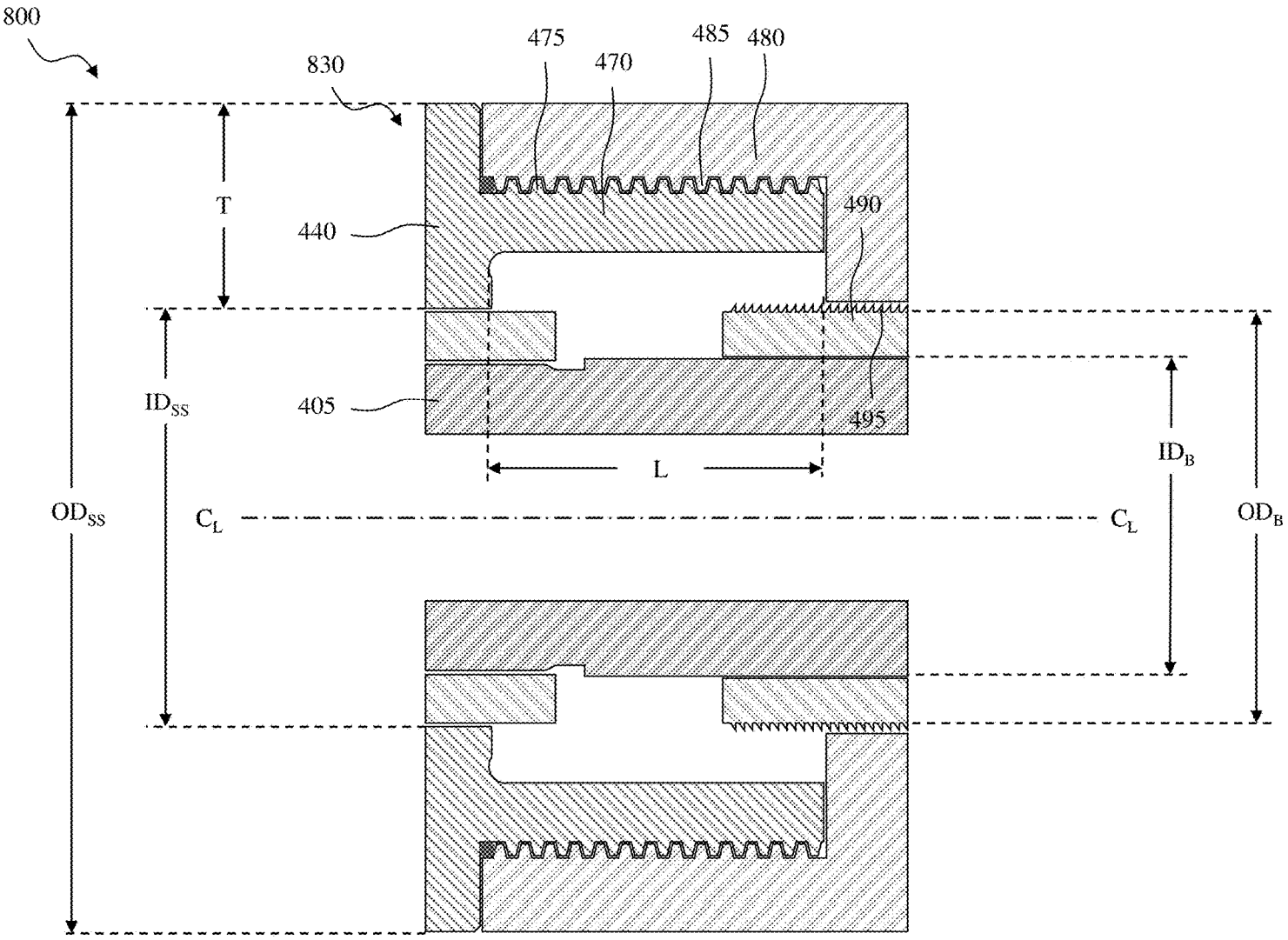

In one or more embodiments, the first retaining blocks 510 are located in ones of the (n) segments 460, and the ratch latch body 530 further includes second retaining blocks 520 positioned in second openings in others of the (n) segments 460, the second retaining blocks 520 having second retaining block teeth 525 that are offset from the stroke sleeve teeth 445 a second direction by a second offset distance ($d_2$). For example, as shown in FIG. 5F the base teeth 495 have the fixed pitch, and in this embodiment the stroke sleeve teeth 445 are centered upon the base teeth 495. However, as shown, the second retaining block teeth 525 are offset from the stroke sleeve teeth 445 (e.g., in relation to the fixed pitch base teeth 495) by the second offset distance ($d_2$). Furthermore, the second retaining block teeth 525 are offset in a second direction (e.g., opposite direction . . . to the left in this embodiment). In at least one embodiment, the second offset distance ($d_2$) ranges from $1/8^{th}$ of a thread to ½ of a thread.

In at least one embodiment, the first offset distance ($d_1$) and the second offset distance ($d_2$) are similar distances in opposite directions, but in other embodiments may be different distances in opposite directions or even different distances in the same direction. Further to this embodiment, the first retaining blocks 510 and second retaining blocks 520 may circumferentially alternate in ones of the (n) segments 460 in one or more embodiments, and thus act as ratchet blocks.

In one or more embodiments, spring members 540 engage with the first retaining blocks 510 and second retaining blocks 520 to hold them radially engaged with the base 490. Any type of spring member 540 currently known or hereafter discovered could be used and remain within the scope of the present disclosure.

In one or more other embodiments, the first retaining blocks 510 and second retaining blocks 520 are affixed by the base 490. In accordance with this embodiment, the first retaining blocks 510 and second retaining blocks 520 may move outward to engage the stroke sleeve teeth 445.

Turning to FIGS. 6A through 6D, illustrated are cross-sectional views of a scaling/anchoring subassembly 600 designed, manufactured and operated according to an alternative embodiment of the disclosure. The sealing/anchoring subassembly 600 is similar in many respects to the sealing/anchoring subassembly 400 illustrated in FIGS. 4A through 4D above. Accordingly, like reference numbers have been used to indicate similar, if not identical, features. The scaling/anchoring subassembly 600 differs, for the most part, from the sealing/anchoring subassembly 400, in that it includes additional/different features for its ratch latch body 630. For example, in the embodiment of FIGS. 6A through 6D, the sealing/anchoring subassembly 600 further includes a band 610 disposed in the slot 450 radially about the (n) segments 460. The term band, as used herein, encompasses traditional bands, retaining rings (e.g., smalley retaining rings), snap rings, traditional springs, garter springs (e.g., compression garter springs), etc. that could in certain embodiments be circumferentially and continuously positioned about the (n) segments 460. The band 610, in one or more embodiments, is an elastic band 610, such as an O-ring or other similar feature. In one or more other embodiments, the band 610 is a plastic or metal band 610. In at least one embodiment, the band 610 adjusts the radial stiffness of the segments 460 and enhances the engagement of the stroke sleeve teeth 445 with the base teeth 495 while keeping the necessary flexibility for ratcheting.

Turning to FIGS. 7A through 7D, illustrated are cross-sectional views of a sealing/anchoring subassembly 700 designed, manufactured and operated according to an alternative embodiment of the disclosure. The sealing/anchoring subassembly 700 is similar in many respects to the sealing/anchoring subassembly 600 illustrated in FIGS. 6A through 6D above. Accordingly, like reference numbers have been used to indicate similar, if not identical, features. The sealing/anchoring subassembly 700 differs, for the most part, from the sealing/anchoring subassembly 600, in that it includes additional/different features for its ratch latch body 730. For example, in the embodiment of FIGS. 7A through 7D, the sealing/anchoring subassembly 700 further includes positioning blocks 710 located within the spacing 462 between each of the (n) segments 460. The positioning blocks 710, in one or more embodiments, may be used to resist any potential twist or tangential (hoop) deformation of the segments 460. Furthermore, in at least one embodiment, the band 610 is engaged with the positioning blocks 710, for example holding the positioning blocks 710 radially engaged with the base 490.

Turning to FIGS. 8A through 8D, illustrated are cross-sectional views of a scaling/anchoring subassembly 800 designed, manufactured and operated according to an alternative embodiment of the disclosure. The sealing/anchoring subassembly 800 is similar in many respects to the sealing/anchoring subassembly 400 illustrated in FIGS. 4A through 4D above. Accordingly, like reference numbers have been used to indicate similar, if not identical, features. The sealing/anchoring subassembly 800 differs, for the most part, from the sealing/anchoring subassembly 400, in that it includes additional/different features for its ratch latch body 830. For example, in the embodiment of FIGS. 8A through 8D, the sealing/anchoring subassembly 800 includes a tapered integrated locker ring 855. In at least one embodiment, the tapered integrated locker ring 855 has an opening slot width (Co) greater than an inside slot width (ci). In one or more embodiments, the tapered integrated locker ring represents a non-prismatic cantilever beam concept, where the tapered shape is a factor to control the radial stiffness of the integrated locker ring 855. Alternatively, the base can be made flexible instead having similar circumferential slots.

Aspects Disclosed Herein Include

A. A scaling/anchoring subassembly, the sealing/anchoring subassembly including: 1) a mandrel; 2) a sealing/ anchoring element positioned about the mandrel, the isolation element configured to move between a radially retracted state and a radially expanded state; 3) a ratch latch body coupled to the sealing/anchoring element, the ratch latch body configured to hold the scaling/anchoring element in the radially expanded state, the ratch latch body including: a) a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon; and b) a base having a base outer diameter ($OD_B$) and a base inner diameter ($ID_B$), the base outer diameter ($OD_B$) having a plurality of base teeth disposed thereon, the stroke sleeve teeth and the base teeth configured to directly ratchet along one another to hold the sealing/anchoring element in the radially expanded state.

B. A well system, the well system including: 1) a wellbore located in a subterranean formation; and 2) a sealing/anchoring assembly positioned in the wellbore, the sealing/anchoring assembly including: a) a mandrel; b) a sealing/anchoring element positioned about the mandrel, the sealing/anchoring element configured to move between a radially retracted state and a radially expanded state; and c) a ratch latch body coupled to the sealing/anchoring element, the ratch latch body configured to hold the sealing/anchoring element in the radially expanded state, the ratch latch body including: i) a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon; and ii) a base having a base outer diameter ($OD_B$) and a base inner diameter ($ID_B$), the base outer diameter ($OD_B$) having a plurality of base teeth disposed thereon, the stroke sleeve teeth and the base teeth configured to directly ratchet along one another to hold the sealing/anchoring element in the radially expanded state.

C. A method, the method including: 1) positioning a sealing/anchoring assembly within a wellbore located in a subterranean formation, the sealing/anchoring assembly including: a) mandrel; b) a sealing/anchoring element positioned about the mandrel, the sealing/anchoring element configured to move between a radially retracted state and a radially expanded state; and c) a ratch latch body coupled to the sealing/anchoring element, the ratch latch body configured to hold the sealing/anchoring element in the radially expanded state, the ratch latch body including: i) a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon; and ii) a base having a base outer diameter ($OD_B$) and a base inner diameter ($ID_B$), the base outer diameter ($OD_B$) having a plurality of base teeth disposed thereon, the stroke sleeve teeth and the base teeth configured to directly ratchet along one another to hold the scaling/anchoring element in the radially expanded state; and 2) actuating the stroke sleeve to move the sealing/anchoring element from the radially retracted state to the radially expanded state.

Aspects A, B and C may have one or more of the following additional elements in combination: Element 1: further including a circumferential slot formed within a thickness (T) of the stroke sleeve between the stroke sleeve outer diameter ($OD_{SS}$) and the stroke sleeve inner diameter ($ID_{SS}$), the slot forming an integrated locker ring. Element 2: wherein the integrated locker ring includes (n) segments around its circumference, the (n) segments configured to allow the integrated locker ring to radially deform via a cantilever action. Element 3: wherein (n) is at least four. Element 4: wherein (n) is at least six. Element 5: further including first retaining blocks positioned in first openings in the (n) segments, the first retaining blocks having first retaining block teeth that are offset from the stroke sleeve teeth a first direction by a first offset distance ($d_1$). Element 6: wherein the first offset distance ($d_1$) ranges from $1/8^{th}$ of a thread to ½ of a thread. Element 7: wherein the first retaining blocks are located in ones of the (n) segments, and further including second retaining blocks positioned in second openings in others of the (n) segments, the second retaining blocks having second retaining block teeth that are offset from the stroke sleeve teeth a second direction by a second offset distance ($d_2$). Element 8: wherein the second direction is a second opposite direction to the first direction. Element 9: wherein the second offset distance ($d_2$) ranges from $1/8^{th}$ of a thread to ½ of a thread. Element 10: wherein the first retaining blocks and second retaining blocks circumferentially alternate. Element 11: further including spring members engaged with the first retaining blocks and second retaining blocks to hold them radially engaged with the base. Element 12: further including a band disposed in the slot radially about the (n) segments. Element 13: wherein the band is engaged with positioning blocks located within a spacing between each of the (n) segments. Element 14: wherein the integrated locker ring is a tapered integrated locker ring, the tapered integrated locker ring having an opening slot width ($e_o$) greater than an inside slot width ($e_i$). Those skilled in the art to which this application relates will appreciate that other and further additions, deletions, substitutions and modifications may be made to the described embodiments. Element 15: wherein the wellbore is a main wellbore, and further including a lateral wellbore extending from the main wellbore, the sealing/anchoring assembly positioned proximate an intersection between the main wellbore and the lateral wellbore.

Those skilled in the art to which this application relates will appreciate that other and further additions, deletions, substitutions and modifications may be made to the described embodiments.

What is claimed is:

1. A sealing/anchoring subassembly, comprising:

a mandrel;

a sealing/anchoring element positioned about the mandrel, the sealing/anchoring element configured to move between a radially retracted state and a radially expanded state; and a ratch latch body coupled to the sealing/anchoring element, the ratch latch body configured to hold the sealing/anchoring element in the radially expanded state, the ratch latch body including:

a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon;

a circumferential slot formed within a thickness (T) of the stroke sleeve between the stroke sleeve outer diameter (ODSS) and the stroke sleeve inner diameter (IDSS), the slot forming an integrated locker ring; and a base having a base outer diameter ($OD_B$) and a base inner diameter ($ID_B$), the base outer diameter ($OD_B$) having a plurality of base teeth disposed thereon, the stroke sleeve teeth and the base teeth configured to directly ratchet along one another to hold the sealing/anchoring element in the radially expanded state.

2. The sealing/anchoring subassembly as recited in claim 1, wherein the integrated locker ring includes (n) segments around its circumference, the (n) segments configured to allow the integrated locker ring to radially deform via a cantilever action.

3. The sealing/anchoring subassembly as recited in claim 2, wherein (n) is at least four.

4. The sealing/anchoring subassembly as recited in claim 2, wherein (n) is at least six.

5. The sealing/anchoring subassembly as recited in claim 2, further including first retaining blocks positioned in first openings in the (n) segments, the first retaining blocks having first retaining block teeth that are offset from the stroke sleeve teeth a first direction by a first offset distance ($d_1$).

6. The sealing/anchoring subassembly as recited in claim 5, wherein the first offset distance ($d_1$) ranges from $1/8^{th}$ of a thread to ½ of a thread.

7. The sealing/anchoring subassembly as recited in claim 5, wherein the first retaining blocks are located in ones of the (n) segments, and further including second retaining blocks positioned in second openings in others of the (n) segments, the second retaining blocks having second retaining block teeth that are offset from the stroke sleeve teeth a second direction by a second offset distance ($d_2$).

8. The sealing/anchoring subassembly as recited in claim 7, wherein the second direction is a second opposite direction to the first direction.

9. The sealing/anchoring subassembly as recited in claim 7, wherein the second offset distance ($d_2$) ranges from $1/8^{th}$ of a thread to ½ of a thread.

10. The sealing/anchoring subassembly as recited in claim 7, wherein the first retaining blocks and second retaining blocks circumferentially alternate.

11. The sealing/anchoring subassembly as recited in claim 7, further including spring members engaged with the first retaining blocks and second retaining blocks to hold them radially engaged with the base.

12. A well system, comprising:

a wellbore located in a subterranean formation; and a sealing/anchoring assembly positioned in the wellbore, the sealing/anchoring assembly including:

a mandrel;

a sealing/anchoring element positioned about the mandrel, the sealing/anchoring element configured to move between a radially retracted state and a radially expanded state; and a ratch latch body coupled to the sealing/anchoring element, the ratch latch body configured to hold the sealing/anchoring element in the radially expanded state, the ratch latch body including:

a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon;

a circumferential slot formed within a thickness (T) of the stroke sleeve between the stroke sleeve outer diameter (ODSS) and the stroke sleeve inner diameter (IDSS), the slot forming an integrated locker ring; and a base having a base outer diameter ($OD_B$) and a base inner diameter ($ID_B$), the base outer diameter ($OD_B$) having a plurality of base teeth disposed thereon, the stroke sleeve teeth and the base teeth configured to directly ratchet along one another to hold the sealing/anchoring element in the radially expanded state.

13. The well system as recited in claim 12, wherein the wellbore is a main wellbore, and further including a lateral wellbore extending from the main wellbore, the sealing/anchoring assembly positioned proximate an intersection between the main wellbore and the lateral wellbore.

14. The well system as recited in claim 12, wherein the integrated locker ring includes (n) segments around its circumference, the (n) segments configured to allow the integrated locker ring to radially deform via a cantilever action.

15. The well system as recited in claim 14, wherein (n) is at least four.

16. The well system as recited in claim 14, wherein (n) is at least six.

17. The well system as recited in claim 14, further including first retaining blocks positioned in first openings in the (n) segments, the first retaining blocks having first retaining block teeth that are offset from the stroke sleeve teeth a first direction by a first offset distance ($d_1$).

18. The well system as recited in claim 17, wherein the first offset distance ($d_1$) ranges from $1/8^{th}$ of a thread to ½ of a thread.

19. The well system as recited in claim 17, wherein the first retaining blocks are located in ones of the (n) segments, and further including second retaining blocks positioned in second openings in others of the (n) segments, the second retaining blocks having second retaining block teeth that are offset from the stroke sleeve teeth a second direction by a second offset distance ($d_2$).

20. The well system as recited in claim 19, wherein the second direction is a second opposite direction to the first direction.

21. The well system as recited in claim 19, wherein the second offset distance ($d_2$) ranges from $1/8^{th}$ of a thread to ½ of a thread.

22. The well system as recited in claim 19, wherein the first retaining blocks and second retaining blocks circumferentially alternate.

23. The well system as recited in claim 19, further including spring members engaged with the first retaining blocks and second retaining blocks to hold them radially engaged with the base.

24. A method, comprising:

positioning a sealing/anchoring assembly within a wellbore located in a subterranean formation, the sealing/anchoring assembly including:

a mandrel;

a sealing/anchoring element positioned about the mandrel, the sealing/anchoring element configured to move between a radially retracted state and a radially expanded state; and a ratch latch body coupled to the sealing/anchoring element, the ratch latch body configured to hold the sealing/anchoring element in the radially expanded state, the ratch latch body including:

a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon;

a circumferential slot formed within a thickness (T) of the stroke sleeve between the stroke sleeve outer diameter (ODSS) and the stroke sleeve inner diameter (IDSS), the slot forming an integrated locker ring; and a base having a base outer diameter ($OD_B$) and a base inner diameter ($ID_B$), the base outer diameter ($OD_B$) having a plurality of base teeth disposed thereon, the stroke sleeve teeth and the base teeth configured to directly ratchet along one another to hold the sealing/anchoring element in the radially expanded state; and actuating the stroke sleeve or base to move the sealing/anchoring element from the radially retracted state to the radially expanded state.

* * * * *